US009554644B2

(12) United States Patent
Flaherty et al.

(10) Patent No.: US 9,554,644 B2
(45) **Date of Patent: *Jan. 31, 2017**

(54) ADJUSTABLE DESK PLATFORM

(71) Applicant: Varidesk, LLC, Coppell, TX (US)

(72) Inventors: Daniel G. Flaherty, Coppell, TX (US); David Patton, Flower Mound, TX (US); Sheng Chien Wang, Taichung (TW)

(73) Assignee: Varidesk, LLC, Coppell, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/014,730

(22) Filed: Feb. 3, 2016

(65) Prior Publication Data

US 2016/0150876 A1 Jun. 2, 2016

Related U.S. Application Data

(63) Continuation of application No. 14/714,682, filed on May 18, 2015, now Pat. No. 9,277,809, which is a (Continued)

(51) Int. Cl.
*A47B 11/00* (2006.01)
*A47B 9/16* (2006.01)

(Continued)

(52) U.S. Cl.
CPC . *A47B 9/16* (2013.01); *A47B 9/00* (2013.01); *A47B 9/18* (2013.01); *A47B 21/00* (2013.01);

(Continued)

(58) Field of Classification Search
CPC ..... A47B 1/03; A47B 21/0314; A47B 21/00; A47B 21/02; A47B 21/03; A47B 2021/0321; A47B 2021/0364; A47B 9/16

(Continued)

(56) References Cited

U.S. PATENT DOCUMENTS 210,031 A 11/1878 Hawthorn
226,053 A * 3/1880 Finnegan ..... A47B 21/0314 108/138

(Continued)

FOREIGN PATENT DOCUMENTS

AU 2014216002 A1 3/2015
CN 1231146 A 10/1999

(Continued)

OTHER PUBLICATIONS

Engber, Daniel, "Who Made That: Standing Desk," Innovation, Mar. 23, 2014, p. 14.

(Continued)

*Primary Examiner* — Jose V Chen
(74) *Attorney, Agent, or Firm* — Venable LLP; Steven J. Schwarz

(57) ABSTRACT

An adjustable desk platform can include: an upper platform defining a substantially planar work surface; a base located beneath the upper platform, the base defining a bottom surface without legs that is adapted to sit on an existing desk; first and second sets of arms coupling the upper platform to the base, wherein the first and second sets of arms are adapted for movement of the upper platform substantially in parallel with the base between a fully raised position and a fully lowered position; and a user-operable locking mechanism associated with the upper platform, the locking mechanism adapted to releasably lock the upper platform in the fully raised position, and in at least one intermediate position between the fully raised position and the fully lowered position. Other features and embodiments are discussed.

36 Claims, 24 Drawing Sheets

Related U.S. Application Data continuation-in-part of application No. 14/183,052, filed on Feb. 18, 2014, now Pat. No. 9,055,810, which is a continuation-in-part of application No. 14/013,285, filed on Aug. 29, 2013, now Pat. No. 9,113,703, which is a continuation-in-part of application No. 13/642,651, filed as application No. PCT/US2012/048775 on Jul. 30, 2012, now Pat. No. 8,671,853.

(60) Provisional application No. 61/651,101, filed on May 24, 2012.

(51) Int. Cl.

| | |
|---|---|
| ***A47B 9/18*** | (2006.01) |
| ***A47B 21/02*** | (2006.01) |
| ***A47B 21/04*** | (2006.01) |
| ***A47B 21/00*** | (2006.01) |
| ***A47B 9/00*** | (2006.01) |
| ***A47B 21/03*** | (2006.01) |

(52) U.S. Cl.
CPC ..... *A47B 21/02* (2013.01); *A47B 21/03* (2013.01); *A47B 21/04* (2013.01); *A47B 2200/0041* (2013.01)

(58) Field of Classification Search
USPC ..... 108/17, 96, 95, 138, 65, 69, 43, 50.01,108/50.02, 92, 48
See application file for complete search history.

(56) References Cited

U.S. PATENT DOCUMENTS 558,519 A 4/1896 Welker
588,519 A 8/1897 Welker
644,247 A * 2/1900 Henley ..... A47B 1/03 108/17
775,731 A 11/1904 McCabe, Jr.
780,829 A * 1/1905 Stengel ..... A47B 21/0314 108/138
982,098 A 1/1911 Russ
1,040,255 A 10/1912 Altermatt
1,161,794 A 11/1915 Sheehan
1,244,520 A * 10/1917 Lloyd ..... A47B 1/03 108/17
1,669,065 A 5/1928 Minton
1,689,445 A 10/1928 Merriman
1,824,822 A * 9/1931 Kradolfer ..... A47B 21/02 108/97
2,170,098 A 8/1939 Stephenson
2,406,436 A * 8/1946 Peter ..... A47B 31/00 108/17
2,451,259 A 10/1948 Tronic
2,531,140 A 11/1950 Linde
2,545,515 A 3/1951 Gannett
2,566,668 A 9/1951 Krueger
2,585,535 A 2/1952 Carlsson
2,630,359 A * 3/1953 Schade ..... A47B 17/02 108/136
2,641,247 A 6/1953 Genebach
2,727,799 A 12/1955 Keal
2,766,088 A 10/1956 Jackson et al.
2,892,050 A 6/1959 May
2,913,122 A * 11/1959 Lomas ..... A47B 5/02 108/17
3,203,373 A 8/1965 King
3,347,184 A 10/1967 Kiraly
3,410,328 A 11/1968 Sasai
3,472,183 A 10/1969 Goodman
3,474,743 A 10/1969 Blevins
3,494,306 A * 2/1970 Aguilar ..... A47B 17/02 108/138
4,032,103 A 6/1977 Ehrichs
4,073,240 A 2/1978 Fly
4,194,452 A * 3/1980 Crowther ..... A47B 9/00 108/138
4,249,749 A 2/1981 Collier
4,296,694 A 10/1981 Kobayashi
4,383,486 A 5/1983 Reineman et al.
4,437,411 A 3/1984 Maxwell
4,515,086 A 5/1985 Kwiecinski et al.
4,558,847 A 12/1985 Coates
4,624,657 A 11/1986 Gould et al.
4,625,657 A * 12/1986 Little ..... A47B 21/0314 108/138
4,685,731 A 8/1987 Migut
4,691,886 A 9/1987 Wendling et al.
4,714,025 A 12/1987 Wallin et al.
4,729,533 A 3/1988 Hillary et al.
4,926,760 A 5/1990 Sack
5,037,054 A 8/1991 McConnell
5,039,054 A 8/1991 Pai
5,048,784 A 9/1991 Schwartz et al.
5,088,420 A 2/1992 Russell
5,088,421 A 2/1992 Beckstead
5,092,652 A 3/1992 Macaluso
5,174,223 A 12/1992 Nagy et al.
5,176,351 A * 1/1993 Moore ..... A47B 21/0314 108/138
5,224,429 A 7/1993 Borgman et al.
5,249,533 A * 10/1993 Moore, III ..... D05B 75/00 108/138
5,324,064 A 6/1994 Sumser et al.
5,325,794 A 7/1994 Hontani
5,375,514 A 12/1994 Dann, Jr.
5,405,204 A 4/1995 Ambrose
5,408,940 A 4/1995 Winchell
5,410,971 A 5/1995 Golden et al.
5,445,353 A 8/1995 Sakamoto
5,456,191 A 10/1995 Hall
5,490,466 A 2/1996 Diffrient
5,495,811 A 3/1996 Carson et al.
5,526,756 A 6/1996 Watson
5,549,052 A * 8/1996 Hoffman ..... A47B 9/00 108/138
5,588,377 A 12/1996 Fahmian
5,606,917 A 3/1997 Cauffiel
5,636,711 A 6/1997 Nussbaum
5,649,493 A 7/1997 Blume
5,681,034 A 10/1997 Noniewicz
5,771,814 A 6/1998 Clausen
5,809,908 A 9/1998 Catta et al.
5,823,120 A 10/1998 Holmquist
5,829,948 A 11/1998 Becklund
6,003,450 A 12/1999 Bruckner et al.
6,038,986 A 3/2000 Ransil et al.
6,101,956 A 8/2000 Keil
6,158,359 A 12/2000 Allan et al.
6,213,575 B1 4/2001 Brin, Jr. et al.
6,220,185 B1 4/2001 Pontoppidan
6,220,660 B1 * 4/2001 Bedro ..... B60N 2/468 108/44
6,269,753 B1 8/2001 Roddan
6,283,047 B1 9/2001 Haller(-Hess) et al.
6,286,441 B1 9/2001 Burdi et al.
6,286,812 B1 9/2001 Cherry
6,435,110 B1 8/2002 Keil
6,439,657 B1 8/2002 Tholkes
6,510,803 B1 1/2003 Agee
6,527,235 B1 3/2003 Cotterill
6,546,880 B2 4/2003 Agee
6,550,724 B2 4/2003 Gosling
6,595,144 B1 7/2003 Doyle
6,598,544 B2 7/2003 Laws et al.
6,643,960 B2 11/2003 Manfiotto
6,644,748 B2 11/2003 Tholkes et al.
6,682,030 B2 1/2004 Santoro et al.
6,701,853 B1 3/2004 Hwang
6,702,372 B2 3/2004 Tholkes et al.
6,705,239 B2 3/2004 Doyle
6,726,276 B1 4/2004 Tholkes et al.
6,905,102 B2 6/2005 Lin

(56) References Cited

U.S. PATENT DOCUMENTS

| | | | | |
|---|---|---|---|---|
| 6,907,829 | B2 * | 6/2005 | Bambach | A47B 96/025 108/152 |
| 6,991,199 | B2 | 1/2006 | Carpentier | |
| 7,048,236 | B2 | 5/2006 | Benden et al. | |
| 7,073,464 | B2 | 7/2006 | Keil | |
| 7,077,068 | B1 | 7/2006 | Agee | |
| 7,107,915 | B2 | 9/2006 | Laws et al. | |
| 7,111,825 | B2 | 9/2006 | Landsberger et al. | |
| 7,140,306 | B2 * | 11/2006 | Chen | A47B 21/0314 108/138 |
| 7,201,108 | B2 * | 4/2007 | Eusebi | A47B 9/18 108/71 |
| 7,204,343 | B1 | 4/2007 | Seaman | |
| 7,428,882 | B2 | 9/2008 | Keil | |
| 7,523,905 | B2 | 4/2009 | Timm et al. | |
| 7,654,208 | B2 * | 2/2010 | Patten | A47B 46/005 108/138 |
| 7,677,518 | B2 | 3/2010 | Chouinard et al. | |
| 7,677,678 | B2 | 3/2010 | Mosel et al. | |
| 7,690,317 | B2 | 4/2010 | Beck et al. | |
| 7,703,726 | B2 | 4/2010 | Harrison et al. | |
| 7,827,921 | B2 | 11/2010 | Shields et al. | |
| 7,827,922 | B2 | 11/2010 | Keil | |
| 7,849,789 | B1 | 12/2010 | Whelan | |
| 7,862,409 | B1 | 1/2011 | Sheppard | |
| 7,878,128 | B2 | 2/2011 | Watson et al. | |
| 7,887,014 | B2 | 2/2011 | Lindblad et al. | |
| 7,942,101 | B2 | 5/2011 | Conley | |
| 8,015,638 | B2 | 9/2011 | Shimada et al. | |
| 8,016,305 | B2 | 9/2011 | Cheng | |
| 8,051,782 | B2 | 11/2011 | Nethken et al. | |
| 8,132,518 | B2 | 3/2012 | Kim et al. | |
| 8,276,525 | B2 | 10/2012 | Janssen | |
| 8,443,761 | B2 | 5/2013 | Keil | |
| 8,522,695 | B2 | 9/2013 | Ellegaard | |
| 8,544,391 | B2 | 10/2013 | Knox et al. | |
| 8,671,853 | B2 * | 3/2014 | Flaherty | A47B 9/18 108/138 |
| 8,752,488 | B2 | 6/2014 | Moller | |
| 8,919,264 | B1 | 12/2014 | Lager | |
| 8,935,985 | B2 | 1/2015 | Hjelm | |
| 8,947,215 | B2 | 2/2015 | Mandel et al. | |
| 8,991,320 | B2 | 3/2015 | DesRoches et al. | |
| 9,049,923 | B1 | 6/2015 | Delagey et al. | |
| 9,055,810 | B2 * | 6/2015 | Flaherty | A47B 9/18 |
| 9,084,475 | B2 | 7/2015 | Hjelm | |
| 9,093,930 | B2 | 7/2015 | Koch et al. | |
| 9,113,703 | B2 * | 8/2015 | Flaherty | A47B 9/18 |
| 9,167,894 | B2 | 10/2015 | DesRoches et al. | |
| 9,236,817 | B2 | 1/2016 | Strothmann et al. | |
| 9,277,809 | B2 * | 3/2016 | Flaherty | A47B 9/18 |
| 9,326,598 | B1 | 5/2016 | West et al. | |
| 9,332,839 | B2 | 5/2016 | Ringlein | |
| 9,380,865 | B2 | 7/2016 | Tempas | |
| 2002/0189505 | A1 | 12/2002 | Markofer | |
| 2003/0075080 | A1 | 4/2003 | Allen | |
| 2004/0040480 | A1 | 3/2004 | Hwang | |
| 2004/0094072 | A1 * | 5/2004 | Fabian | F16M 11/10 108/50.01 |
| 2004/0211344 | A1 | 10/2004 | Lor | |
| 2005/0039643 | A1 | 2/2005 | Dailey | |
| 2005/0150438 | A1 | 7/2005 | Allen | |
| 2005/0172869 | A1 | 8/2005 | Schmidt | |
| 2005/0217540 | A1 | 10/2005 | Novak | |
| 2005/0247239 | A1 | 11/2005 | Newhouse et al. | |
| 2005/0248239 | A1 | 11/2005 | Newhouse et al. | |
| 2006/0157628 | A1 | 7/2006 | Mileos et al. | |
| 2006/0262497 | A1 | 11/2006 | Jahlokov | |
| 2006/0266791 | A1 | 11/2006 | Koch et al. | |
| 2007/0034125 | A1 | 2/2007 | Lo | |
| 2007/0163475 | A1 | 7/2007 | Murphy | |
| 2008/0060562 | A1 | 3/2008 | Lor | |
| 2008/0203865 | A1 | 8/2008 | Chouinard et al. | |
| 2008/0245279 | A1 | 10/2008 | Pan | |
| 2009/0145336 | A1 | 6/2009 | Kenny | |
| 2010/0052276 | A1 | 3/2010 | Brunner | |
| 2010/0258040 | A1 | 10/2010 | Coble | |
| 2011/0155023 | A1 | 6/2011 | Krause et al. | |
| 2011/0247532 | A1 | 10/2011 | Jones | |
| 2011/0297196 | A1 | 12/2011 | Durante | |
| 2012/0048151 | A1 | 3/2012 | Moore | |
| 2012/0081468 | A1 | 4/2012 | Ozawa et al. | |
| 2012/0085267 | A1 | 4/2012 | Kenny | |
| 2012/0126072 | A1 | 5/2012 | Pettersson | |
| 2013/0014674 | A1 | 1/2013 | Burkhalter | |
| 2013/0139736 | A1 | 6/2013 | Flaherty | |
| 2013/0199420 | A1 | 8/2013 | Hjelm | |
| 2014/0028168 | A1 | 1/2014 | Klinke | |
| 2014/0096706 | A1 | 4/2014 | Labrosse et al. | |
| 2014/0336822 | A1 | 11/2014 | Kristensen | |
| 2014/0360413 | A1 | 12/2014 | Schenk et al. | |
| 2015/0007756 | A1 | 1/2015 | Kollreider et al. | |
| 2015/0136000 | A1 | 5/2015 | Holtschi et al. | |
| 2015/0216296 | A1 | 8/2015 | Mitchell | |
| 2015/0282607 | A1 | 10/2015 | Lager | |
| 2015/0283012 | A1 | 10/2015 | Koch et al. | |
| 2015/0289641 | A1 | 10/2015 | Ergun et al. | |
| 2016/0000219 | A1 | 1/2016 | Lager | |
| 2016/0051042 | A1 | 2/2016 | Koch | |
| 2016/0081468 | A1 | 3/2016 | Molteni | |
| 2016/0106205 | A1 | 4/2016 | Hall et al. | |
| 2016/0120303 | A1 | 5/2016 | Constantino et al. | |
| 2016/0150876 | A1 | 6/2016 | Flaherty et al. | |

FOREIGN PATENT DOCUMENTS

| | | | |
|---|---|---|---|
| CN | 2517300 | Y | 10/2002 |
| CN | 2759280 | Y | 2/2006 |
| CN | 201022484 | Y | 2/2008 |
| CN | 201210973 | Y | 3/2009 |
| CN | 202168584 | U | 3/2012 |
| CN | 202286955 | U | 7/2012 |
| CN | 102846016 | A | 1/2013 |
| CN | 202664707 | U | 1/2013 |
| CN | 202800587 | U | 3/2013 |
| CN | 202874337 | U | 4/2013 |
| CN | 103976579 | A | 8/2014 |
| CN | 203860788 | U | 10/2014 |
| CN | 203969627 | U | 12/2014 |
| CN | 104337226 | A | 2/2015 |
| CN | 204178672 | U | 2/2015 |
| CN | 204239612 | U | 4/2015 |
| CN | 104605637 | A | 5/2015 |
| CN | 204519826 | U | 8/2015 |
| CN | 204667198 | U | 9/2015 |
| DE | G-9105969 | U1 | 8/1991 |
| DE | 19541759 | A1 | 5/1997 |
| DE | 29705028 | U1 | 7/1997 |
| DE | 102004059923 | A1 | 6/2006 |
| EP | 0513838 | A1 | 11/1992 |
| JP | H 0956484 | A | 3/1997 |
| JP | 2006212390 | A | 8/2006 |
| KR | 20030055058 | A | 7/2003 |
| KR | 20100111389 | A | 10/2010 |
| KR | 101608957 | | 4/2016 |
| NL | 1006365 | C1 | 12/1998 |
| WO | WO-2005/041721 | A2 | 5/2005 |

OTHER PUBLICATIONS

European Search Report issued Dec. 17, 2014 in European Patent Application No. EP 2 842 458 A1.

Extended European Search Report plus Annex, issued Jan. 5, 2015 in European Patent Application No. EP 14 18 2537.

International Search Report Issued Oct. 26, 2012 in related International Patent Application No. PCT/US2012/048775.

Letter and claim chart received via U.S. registered mail from Richard C. Emery Attorney at Law dated Mar. 18, 2015.

Office Action issued in U.S. Appl. No. 14/183,052 on Nov. 7, 2014.

Office Action issued in U.S. Appl. No. 14/013,285 on Sep. 22, 2014.

Written Opinion issued Oct. 26, 2012 in related International Patent Application No. PCT/US2012/048775.

(56) References Cited

OTHER PUBLICATIONS

Chinese Search Report including English translation, dated Apr. 16, 2015 in Chinese Patent Application No. 201210358008.6.
Chinese Office Action including English translation, dated Apr. 29, 2015 in Chinese Patent Application No. 201210358008.6.
Australian Patent Examination Report No. 1 issued May 8, 2015 in Austrlian Patent Application No. 2013245512.
Extended European Search Report issued Dec. 16, 2015 in European Patent Application No. 12842684.8.
Ergo Desktop, Home of "The Kangaroo" Adjustable Height Desk, posted at ergodesktop.com, Ergo Desktop, © 2015, 4 pages.
Geek Reviews, "Ergodesktop's Kangaroo workstation, an Adjustable Stand Up Desk and Monitor Holder," posted at geekculture.com, Geek Culture, © 2010, 3 pages.
Ergo Desktop, "The Kangaroo Elite," original © 2009, retrieved from https://www.ergodesktop.com/kangaroo-elite on Nov. 14, 2016, 3 pages.
Ergo Desktop, "The Kangaroo Pro," original © 2009, retrieved from https://www.ergodesktop.com/kangaroo-pro on Nov. 14, 2016, 3 pages.
Ergo Desktop, "The Kangaroo," original © 2009, retrieved from https://www.ergodesktop.com/kangaroo# on Nov. 14, 2016, 3 pages.
BioMorph Ergonomic Solutions, Product Literature, © 1993, 2 pages.
BioMorph, Adjustable Worksurface Height & Seating Positions, Product Literature, © 1993, 4 pages.
BioMorph, Net Pricelist and Specifications, 1997, 14 pages.
BioMorph, Interactive Desk, Assembly Instructions, 1995, 1999, 2 pages.
Hewlett-Packard, HP Notebook Stands, Product Literature, © 2011, 2 pages.
Hewlett-Packard, Dual Hinge Notebook Stand, Ergotron, Product Literature, © 2010, 4 pages.
Hewlett-Packard, Dual Hinge Notebook Stand, Quick Setup Guide, © 2010, 2 pages.

* cited by examiner

ADJUSTABLE DESK PLATFORM

CROSS-REFERENCE TO RELATED APPLICATIONS

This application is a continuation of applicant's co-pending U.S. application Ser. No. 14/714,682, filed May 18, 2015, which is a continuation-in-part of applicant's U.S. application Ser. No. 14/183,052, filed on Feb. 18, 2014 (U.S. Pat. No. 9,055,810), which is a continuation-in-part of applicant's U.S. application Ser. No. 14/013,285 (U.S. Pat. No. 9,113,703), filed on Aug. 29, 2013, which is a continuation-in-part of applicant's U.S. application Ser. No. 13/642,651 (U.S. Pat. No. 8,671,853), filed on Oct. 22, 2012, which in turn is the national stage of International Application No. PCT/US2012/48775, filed on Jul. 30, 2012, which in turn claims the priority of U.S. Provisional Application No. 61/651,101, filed on May 24, 2012. The entire contents of the foregoing applications are incorporated herein by reference.

TECHNICAL FIELD

This application relates generally to ergonomic workplace environments, and more particularly, to an adjustable desk platform or desk.

BACKGROUND

Sitting for long periods of time during the work day is generally not good for one's health and wellness. Medical studies show that sitting increases the rate of all-cause mortality, especially from cardiovascular disease, diabetes and obesity, for example. People who sit for most of the day are 50 percent more likely to die of heart attacks. Even if you exercise, the longer you sit the greater the chances you will die. Sitting shuts down the circulation of the fat-absorbing enzyme lipase, while standing up engages muscles and promotes the distribution of lipase, which prompts the body to process fat and cholesterol, independent of the amount of time spent exercising.

There are desks available to be used while standing, and even desks adapted for use while a user is on a treadmill. However, standing for very long periods of time to work is more tiring, dramatically increases the risks of carotid atherosclerosis because of the additional load on the circulatory system, and increases the risks of varicose veins.

Taking regular breaks from sitting for prolonged periods of time can have several positive outcomes. For example, standing can provide more energy during the work day. In addition, because standing burns more calories than sitting, standing can also result in weight loss without changes in diet or exercise. It is also harder to become more tired or lose focus when standing.

Because regular breaks from sitting are beneficial, and because many people during the work day want to remain productive while taking breaks from sitting, and because everyone will sit and stand for different lengths of time at different times during the day, there exists a need to create a work environment that is ergonomic for someone standing as well as sitting, and allows the transition to be easy, quick, and simple.

SUMMARY

According to embodiments, an adjustable desk platform can include: an upper platform defining a substantially planar work surface; a base located beneath the upper platform, the base defining a bottom surface without legs that is adapted to sit on an existing desk; first and second sets of arms coupling the upper platform to the base, wherein the first and second sets of arms are adapted for movement of the upper platform substantially in parallel with the base between a fully raised position and a fully lowered position; and a user-operable locking mechanism associated with the upper platform, the locking mechanism adapted to releasably lock the upper platform in the fully raised position, and in at least one intermediate position between the fully raised position and the fully lowered position.

According to another embodiment, the adjustable desk platform can include: an upper platform defining a substantially planar work surface; a base located beneath the upper platform, the base defining a bottom surface without legs that is adapted to sit on an existing desk; and first and second sets of arms coupling the upper platform to the base, wherein the first and second sets of arms are adapted for movement of the upper platform substantially in parallel with the base between a fully raised position and a fully lowered position; wherein the upper platform moves laterally with respect to the base when moved from the fully lowered position to the fully raised position, and the base includes a counterweight adapted to offset weight of the upper platform when in the raised position.

According to another embodiment, the adjustable desk platform can include: an upper platform defining a substantially planar work surface; a base located beneath the upper platform, the base defining a bottom surface without legs that is adapted to sit on an existing desk; first and second sets of arms coupling the upper platform to the base, wherein the first and second sets of arms are adapted for movement of the upper platform substantially in parallel with the base between a fully raised position and a fully lowered position; and a biasing mechanism associated with at least one of the first and second sets of arms, wherein moving the upper platform toward the fully raised position loads the biasing mechanism.

According to another embodiment, the adjustable desk platform can include: an upper platform defining a substantially planar work surface, the upper platform having first and second hand apertures extending therethrough; a base located beneath the upper platform, the base defining a bottom surface without legs that is adapted to sit on an existing desk; first and second sets of arms coupling the upper platform to the base, wherein the first and second sets of arms are adapted for movement of the upper platform substantially in parallel with the base between a fully raised position and a fully lowered position; and first and second user-operable locking mechanisms associated with the upper platform, each of the first and second locking mechanisms adapted to releasably lock the upper platform in the fully raised position, wherein the first and second locking mechanism each include a user operable handle mounted to an underside of the upper platform substantially adjacent to one of the hand apertures.

Other features and advantages will become apparent from the following description, taken in connection with the accompanying drawings, wherein, by way of illustration and example, embodiments of the invention are disclosed.

BRIEF DESCRIPTION OF THE DRAWINGS

The features and advantages of the invention will be apparent from the following description, as illustrated in the accompanying drawings wherein like reference numbers generally indicate identical, functionally similar, and/or structurally similar elements.

DETAILED DESCRIPTION

Figure 1:
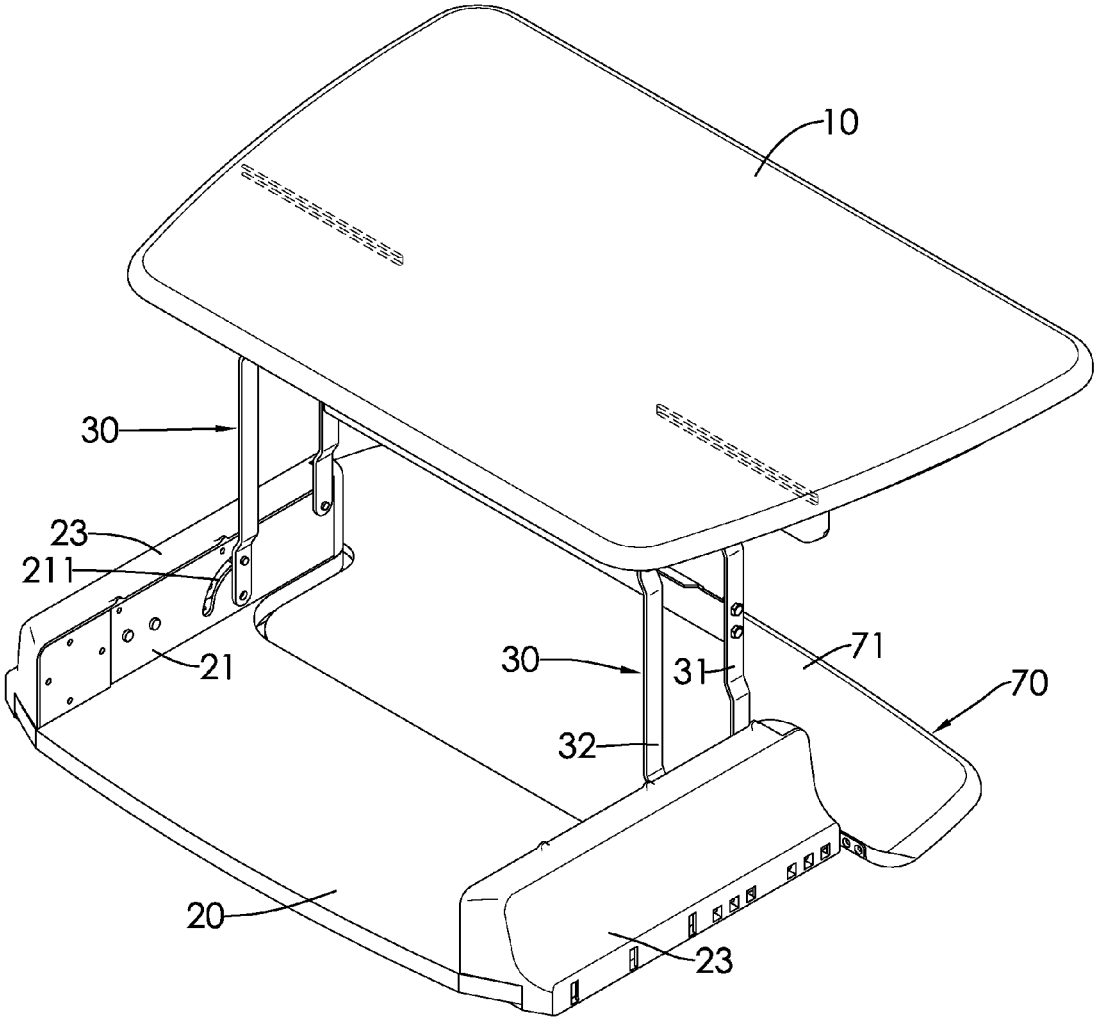
FIG. 1 is a perspective view of an embodiment of an adjustable desk platform.

Embodiments of the invention are discussed in detail below. In describing embodiments, specific terminology is employed for the sake of clarity. However, the invention is not intended to be limited to the specific terminology so selected. While specific embodiments are discussed, it should be understood that this is done for illustration purposes only. A person skilled in the relevant art will recognize that other components and configurations can be used without departing from the spirit and scope of the invention.

Embodiments of the adjustable desk platform described herein can transition between a lower operating position and an upper operating position quickly, easily, and simply. This may be useful, for example, to provide height adjustability to conventional, fixed desktop workspaces. Alternatively, embodiments of the adjustable desk platform can include their own support legs.

Referring to FIGS. 1 to 4, the adjustable desk platform can generally include an upper platform 10, a lower platform 20, and left and right pivot arm sets 30, which can connect the upper platform 10 and lower platform 20. According to embodiments, the upper platform 10 and/or the lower platform 20 can include a substantially planar top surface that can serve as a working surface for the user, for example, to support reading materials, papers, computers, other electronic devices, and the like. The adjustable desk platform can include one or more locking mechanisms 40, for example, one associated with each of the left and right pivot arm sets 30. The adjustable desk platform can also include one or more biasing mechanisms 50 (see FIG. 3), for example, each associated with the left and right pivot arm sets 30. The adjustable desk platform can also include a reinforcement member 60, visible in FIGS. 2 and 4.

Figure 2:
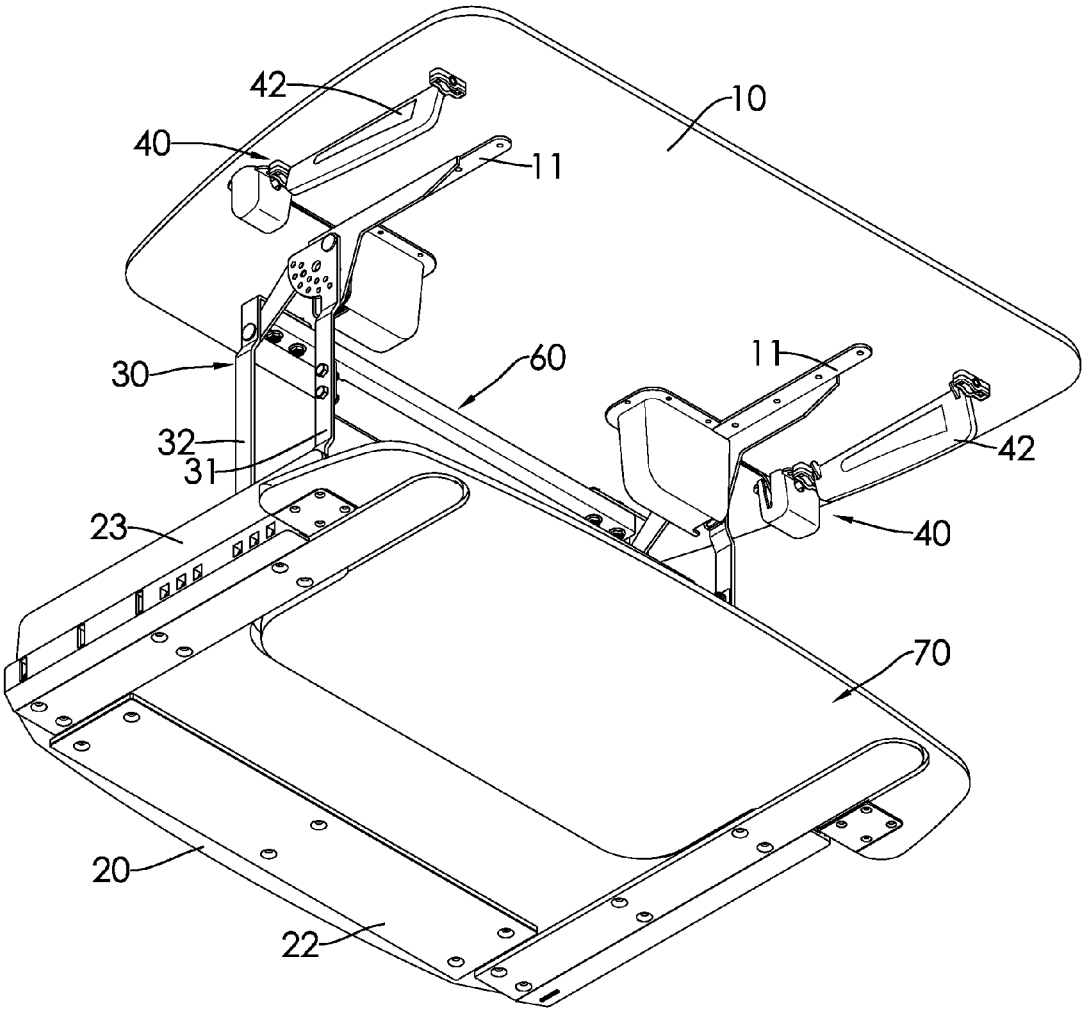
FIG. 2 is another perspective view of the adjustable desk platform of FIG. 1.
Figure 3:
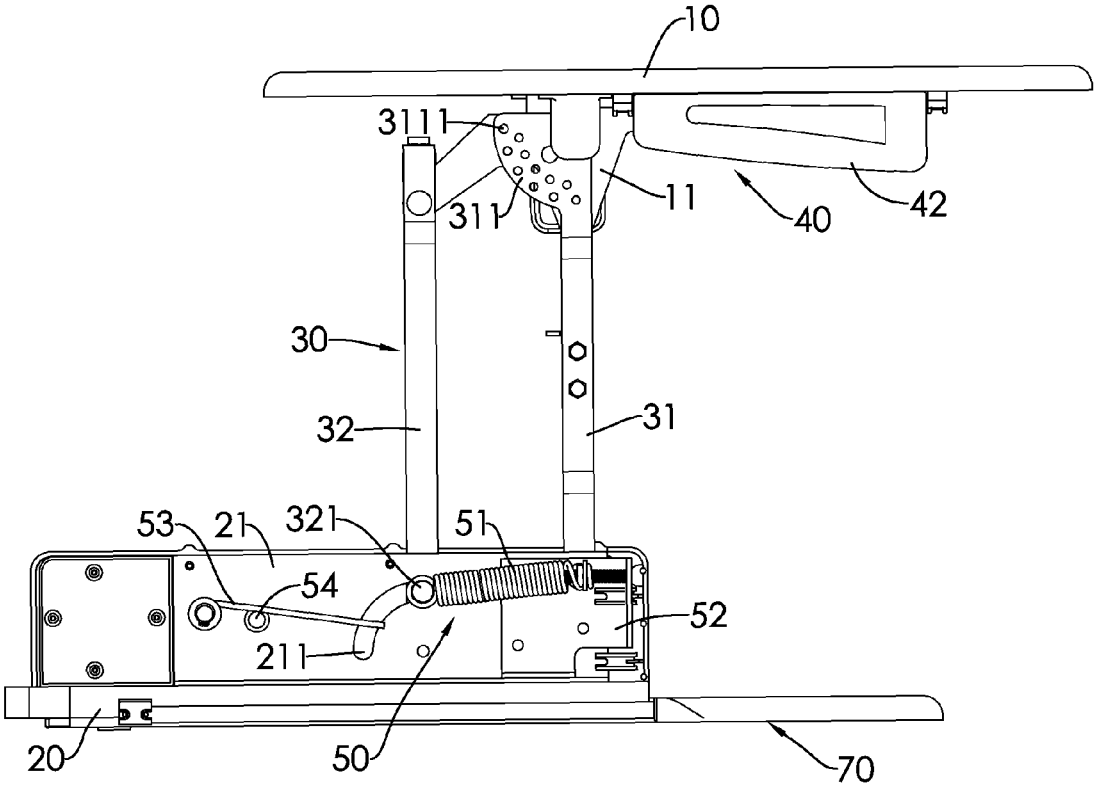
FIG. 3 is a side view of the adjustable desk platform of FIG. 1.
Figure 4:
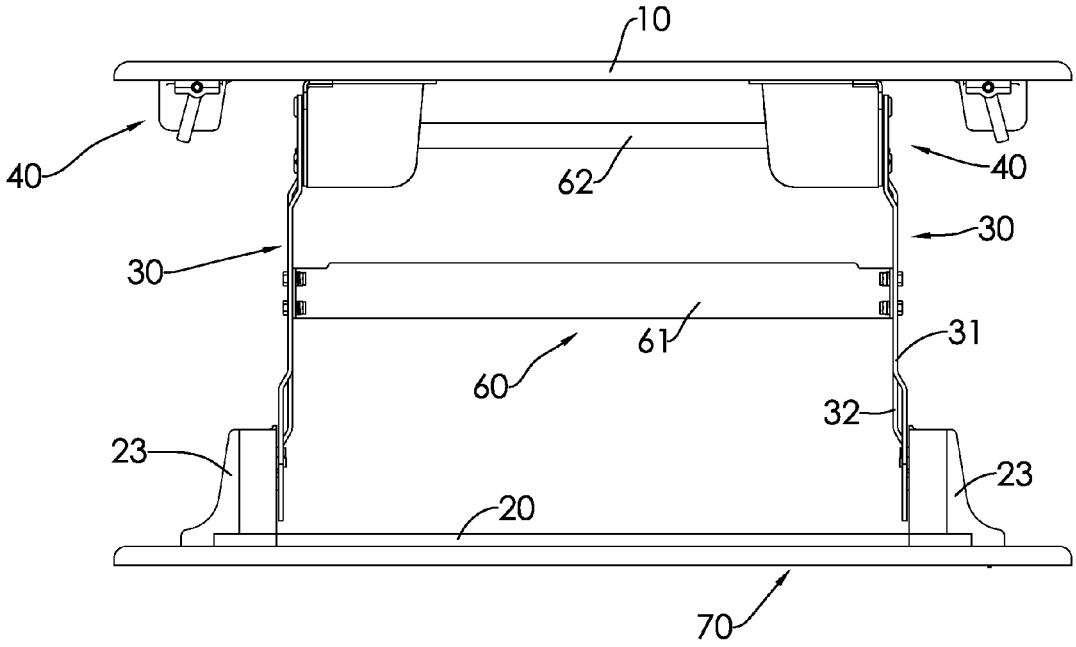
FIG. 4 is front view of the adjustable desk platform of FIG. 1.

Referring to FIG. 2 and FIGS. 4 to 6, lower mounting brackets 11 can be located on upper platform 10, for example, secured thereto, or formed integrally therewith. As shown in the figures, two lower mounting brackets 11 can be secured to the underside of the upper platform 10 at opposite sides of the upper platform 10. As shown in FIG. 2 to FIG. 4, lower platform 20 is located below the upper platform 10, and the pivot arm sets selectively adjust the height of the upper platform 10 with respect the lower platform 20, for example, with the upper platform 10 and the lower platform 20 remaining substantially parallel to one another during movement.

Lower platform 20 can include two upper mounting brackets 21, for example, one located near each side of the lower platform 20. The upper mounting brackets can be formed integrally with the lower platform 20, or alternatively, can be secured thereto using fasteners or other means known in the art. Lower platform 20 can also include one or more counter weights 22, and a housing 23 near each upper mounting bracket 21.

Referring to FIGS. 1 and 2, the upper mounting brackets 21 can be located on the top surface of the lower platform 20, for example, at opposite sides thereof, and the lower mounting brackets 11 can be located on the bottom surface of the upper platform 10, for example, in registry with the upper mounting brackets 21. Each upper mounting bracket 21 can include an arc slot 211, shown in FIGS. 1 and 3. One of the housings 23 can be located adjacent the outer side of each of the upper mounting brackets 21. As shown in FIG.

2, one or more counter weight(s) 22 can be located on the bottom surface of lower platform 20.

Figure 5:
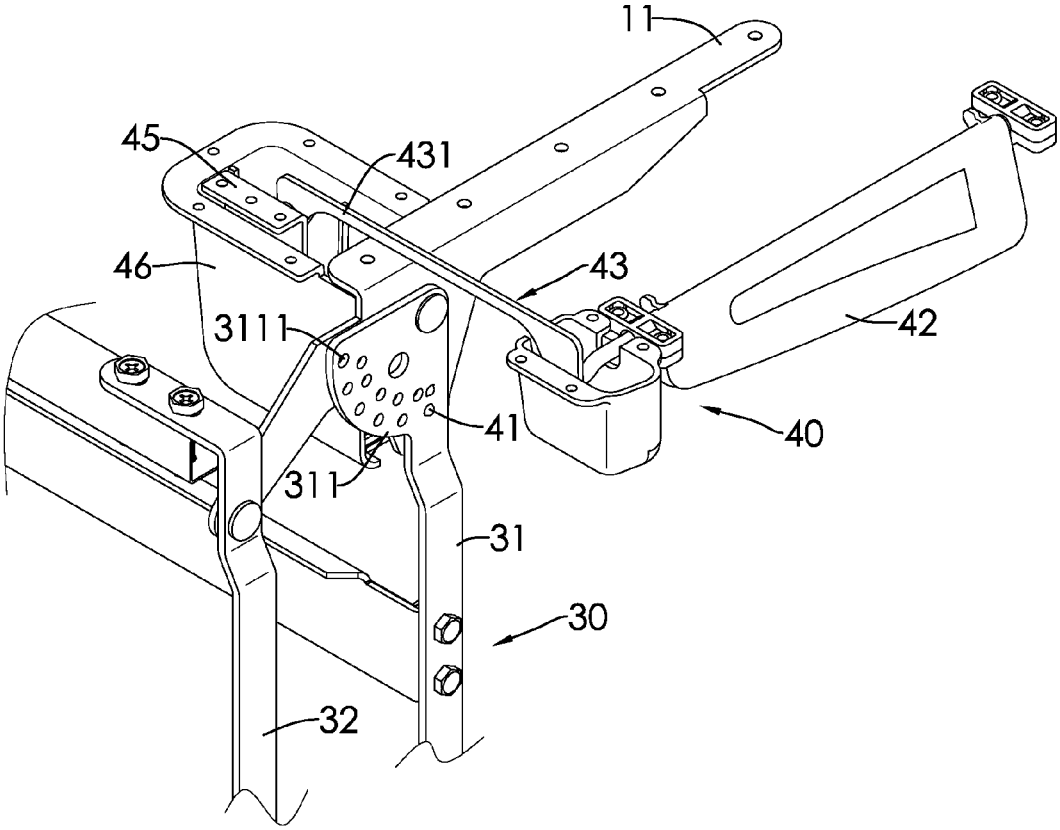
FIG. 5 is perspective view of parts of an embodiment of a locking mechanism of the adjustable desk platform of FIG. 1.

As shown in FIGS. 3 and 5, each pivot arm set 30 is connected to the respective lower mounting bracket 11 on the upper platform 10 and to the respective upper mounting bracket 21 on the lower platform 20. As shown, each pivot arm set 30 can include a main pivot arm 31 and secondary pivot arm 32. The pivot arms 31, 32 can be pivotably connected to the lower mounting bracket 11 at one end, and to upper mounting bracket 21 at the other end using, for example, rivets, fasteners, or other structures known in the art. The main pivot arm 31 and secondary pivot arm 32 can be connected to the lower mounting bracket 11 and upper mounting bracket 21 at different locations, as shown in the figures. The pivot arm sets 30 can be connected to the upper mounting bracket 21 at the opposite side of the respective housing 23. For example, the pivot arm sets 30 can connect to the interior side of the upper mounting brackets 21, while the housings 23 can connect to the exterior sides of the upper mounting brackets 21.

Figure 6:
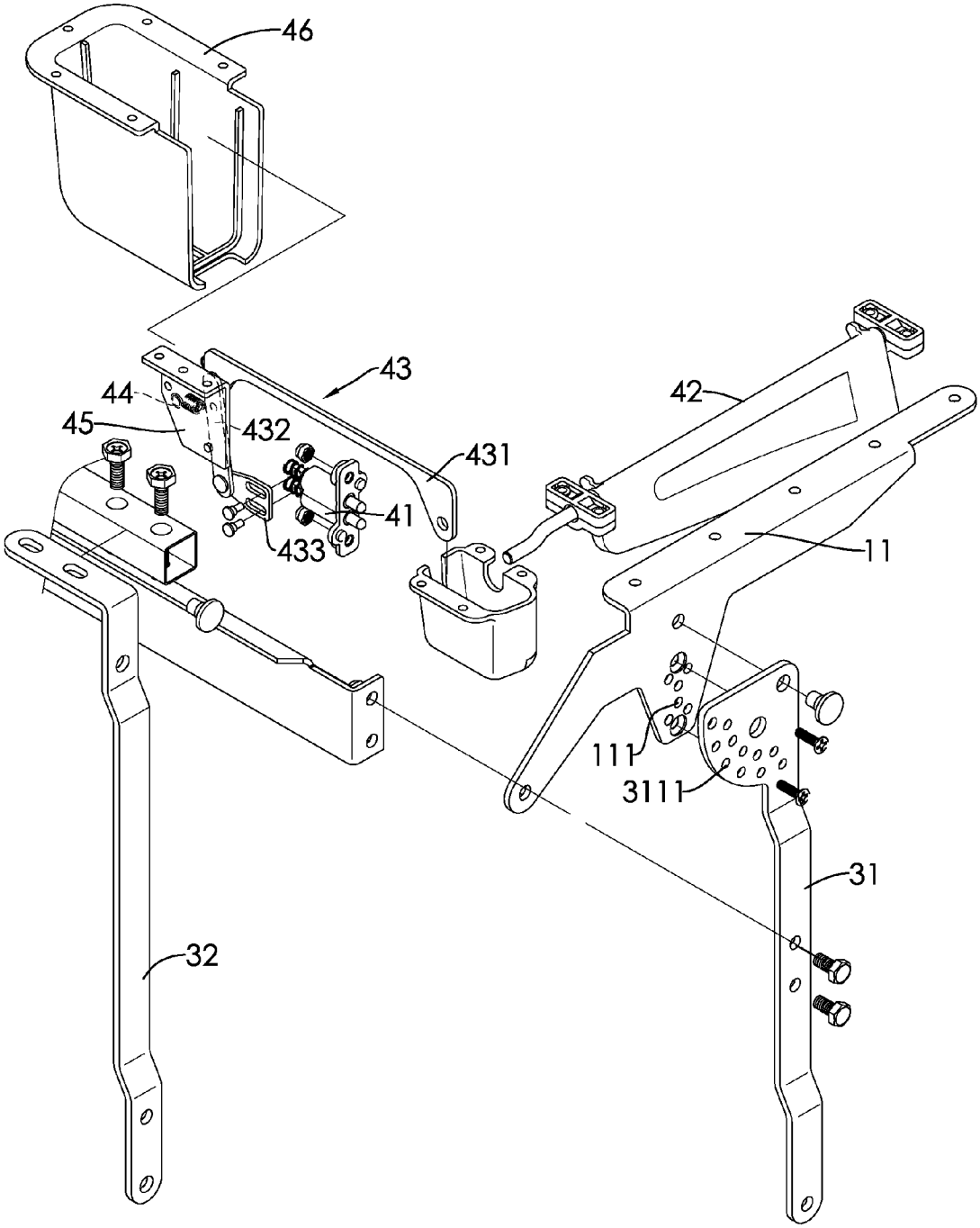
FIG. 6 is an exploded view of the locking mechanism of FIG. 5.
Figure 7:
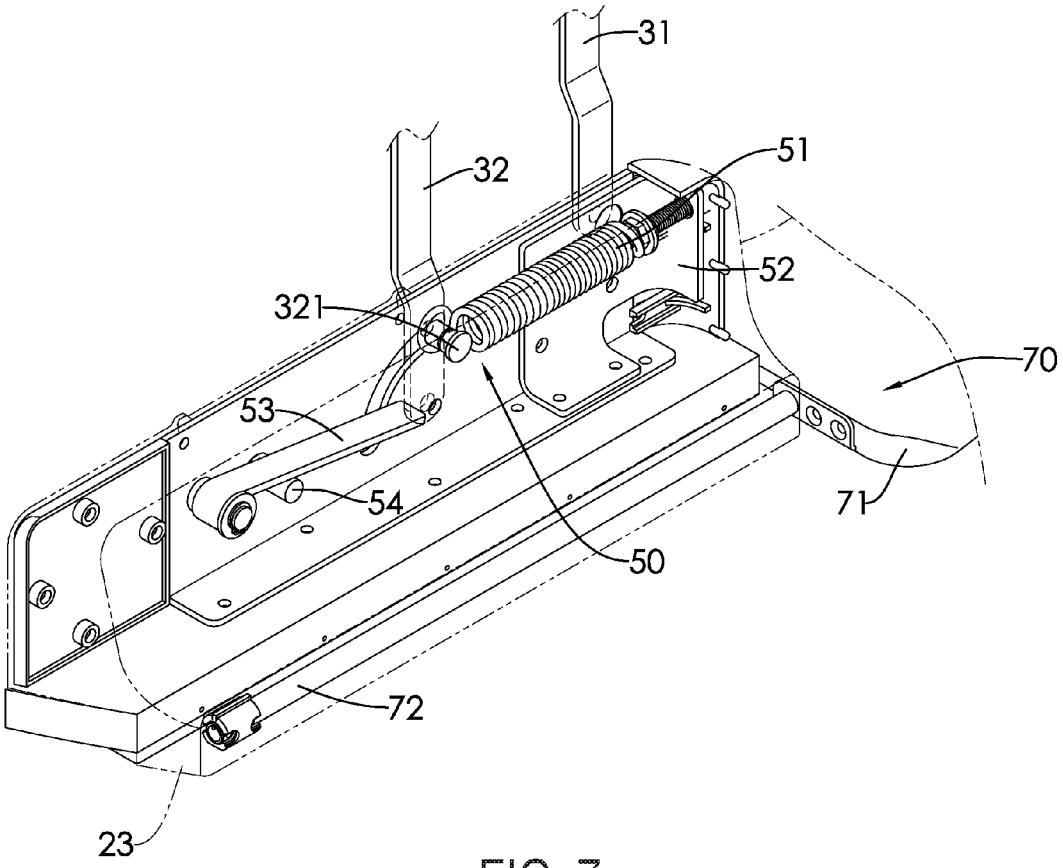
FIG. 7 is a perspective view of an embodiment of a biasing mechanism of the adjustable desk platform of FIG. 1.

Referring to FIGS. 5 and 6, the upper end of each primary pivot arm 31 can include a locking part 311 including a plurality of perforations 3111. The plurality of perforations 3111 can include at least one perforation that is selectively movable into alignment with a hole 111 in the respective lower mounting bracket 11. Referring to FIGS. 3 and 7, each secondary pivot arm 32 can include a boss 321 that slides within the arc slot 211 of the respective upper mounting bracket 21.

Figure 8:
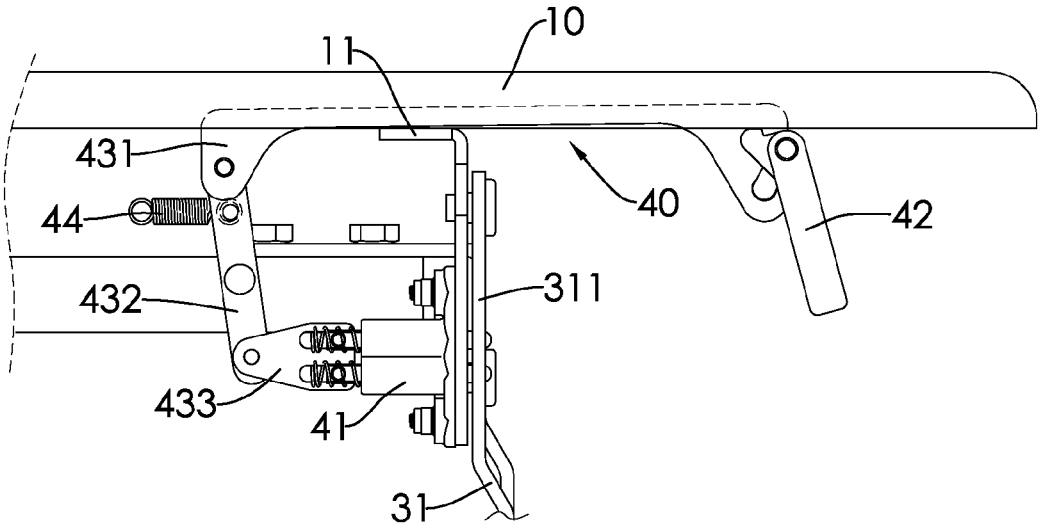
FIG. 8 is a side view of an embodiment of the locking mechanism of the adjustable desk platform of FIG. 1, showing the handle in the locked position.

Referring to FIGS. 2, 4, and 8, one or more locking sets 40 can be located on the bottom of the upper platform 10. For example, each locking set 40 can be fixed on the respective lower mounting bracket 11, however other locations are possible. Referring to FIG. 6, each locking set 42 can include anchors 41. Each anchor 41 can selectively engage one of the perforations 3111 of locking part 311, and can also engage through the hole 111 of lower mounting bracket 11, thereby fixing the main pivot arm 31 in position with respect to the respective lower mounting bracket 11. Furthermore, as shown in FIGS. 5 and 8, each locking set 40 can include a handle 42 and a linkage mechanism 43.

Figure 9:
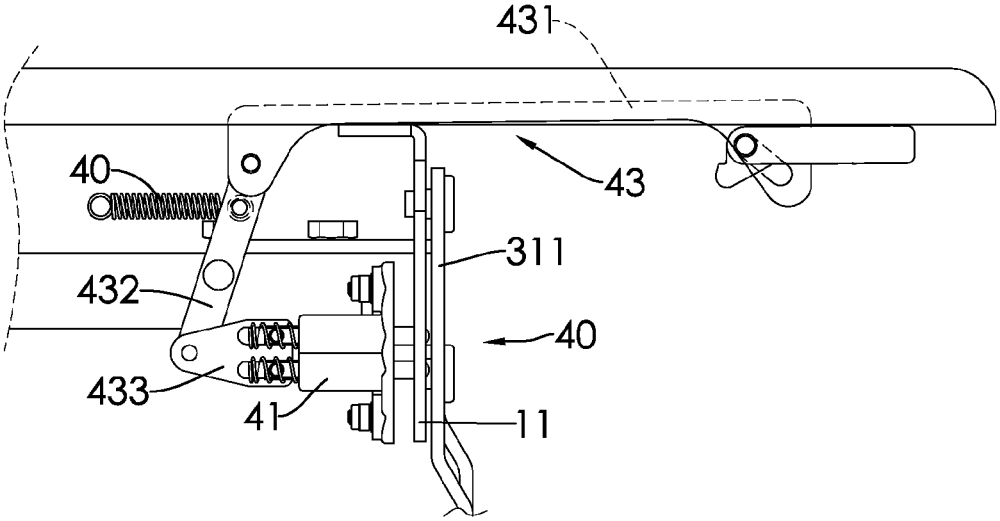
FIG. 9 is a side view of the locking mechanism of FIG. 8 showing the handle in the un-locked position.
Figure 10:
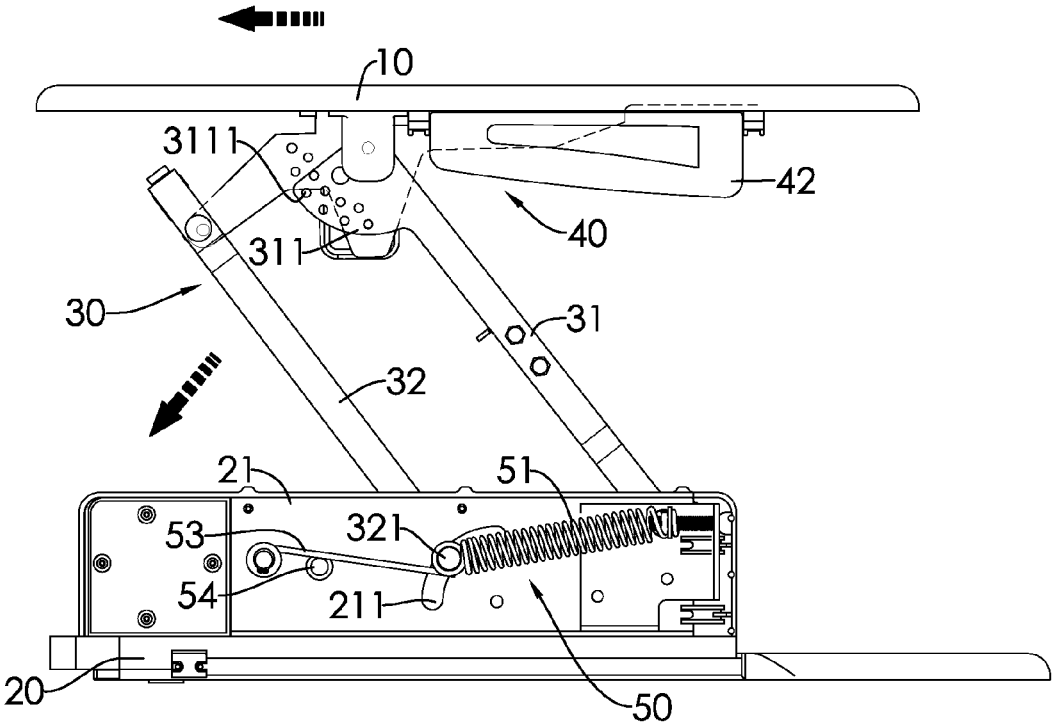
FIG. 10 is a side view of the adjustable desk platform of FIG. 1 showing an example of directional movement of the upper platform relative to the lower platform and the pivot arms.

Referring to FIGS. 5, 6, and 8, each linkage set 43 can include a first linkage 431, a second linkage 432, and a third linkage 433, which, according to an embodiment, are pivotably connected to one another in sequence. Each first linkage 431 can be located underneath the bottom of the upper platform 10, and can have a pivot joint with handle 42. Each third linkage 433 can be connected with the respective anchor 41, for example, by rivets, pins, or other structures extending through the third linkage 433 and anchor(s) 41 as shown in FIGS. 9 and 10. Each locking set 40 can contain a spring 44, adapting piece 45, and housing 46. Each adapting piece 45 of locking set 40 can be secured on the bottom of upper platform 10, and can include a pivot joint with second linkage 432. One end of spring 44 can be connected with adapting piece 45 and the other end of spring 44 can be connected with second linkage 432 in proximity to the first linkage 431. Each locking set 40 can include a housing 46 that can cover at least the second linkage 432, third linkage 433, spring 44, adapting piece 45, and anchor 41. The housing 46 can be connected to the underside of the upper platform 10.

As shown in FIGS. 3 and 7, each biasing mechanism 50 can be located on lower platform 20, and can be connected with pivot arm sets 30 to assist the upper platform 10 in raising/lowering with respect to the lower platform 20. Each biasing mechanism 50 can include a spring 51, a support 52, a booster spring 53, and a pivot point 54. One side of spring 51 can be connected with the support 52 and the other side can form a pivot joint with the secondary arm 32, for example, by attaching to the boss 321. Each support 52 and booster spring 53 of biasing mechanism 50 can be connected with lower platform 20. Arc slot 211 can be selectively connected with the respective secondary pivot arm 32 on the other side of the respective upper mounting bracket 21. Pivot point 54 can be located against the bottom side of booster spring 53. Each biasing mechanism 50 can be located between the respective upper mounting bracket 21 and housing 23, thereby concealing the biasing mechanism 50.

As shown in FIG. 4, reinforcement member 60 may extend between the left and right pivot arm sets 30. According to an embodiment, reinforcement member may include a supporting rod 61 and a separate reinforcement 62, however, other single-member and multi-member embodiments are possible. According to an embodiment, supporting rod 61 can be connected with the primary pivot arm 31 of each pivot arm set 30, and reinforcement 62 can be connected with the secondary pivot arm 32 of each pivot arm set 30. According to embodiments, the reinforcement member can fix the side-to-side distance between the pivot arms and add stability, avoiding side-to-side movement when lifting or lowering upper platform 10 from lower platform 20, and can make the adjustable platform operate smoothly.

When in use, the user can place the adjustable desk platform on to a desktop, and may place items on the upper platform 10 as desired, such as, without limitation, a computer, documents, desk lamps, instruments, and supplies. The user can adjust the height between the upper platform 10 and the lower platform 20 according to their working posture and/or other needs.

FIG. 3 depicts the adjustable desk platform in a fully raised position. Referring to FIGS. 3, 8-10, and 12, in order to lower the adjustable desk platform, the user can pull handle 42, which in turn displaces the first linkage 431, second linkage 432, and third linkage 433. This can, in turn, retract the anchor 41 and cause the anchor to withdrawal from the perforation(s) 3111 of the primary pivot arm 31. As a result, the pivot arm 31 is released from a substantially fixed position, allowing primary pivot arm 31 and secondary pivot arm 32 to move, consequently allowing the upper platform 10 to move with respect to the lower platform 20. Accordingly, the distance between upper platform 10 and lower platform 20 can be reduced, for example, to the fully lowered position shown in FIG. 11, or to some position between the fully raised position and the fully lowered position. This allows the distance between the upper platform 10 and lower platform 20 to be easily set and adjusted.

As shown In FIGS. 3 and 8-11, when the user moves the upper platform 10 and lower platform 20 to a desired height relative to each other, the user can release the handle(s) of locking set(s) 40. As a result, the retraction force of springs 44 of each locking set 40 can move the second linkage 432, causing first linkage 431 and third linkage 433 to move sequentially, thereby causing anchors 41 to lock through the hole 111 of the lower mounting bracket and the corresponding perforations 3111 on primary pivot arm 31. This, in turn, locks the position of the upper platform 10 relative to the lower platform 20.

Figure 11:
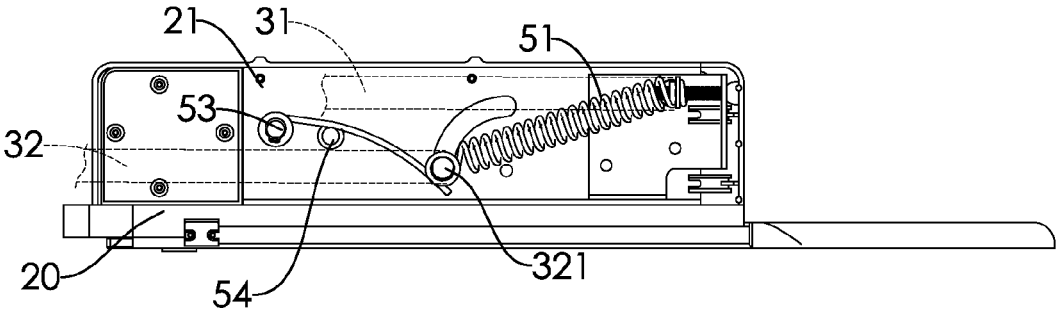
FIG. 11 is a side view of an embodiment of the biasing mechanism.
Figure 12:
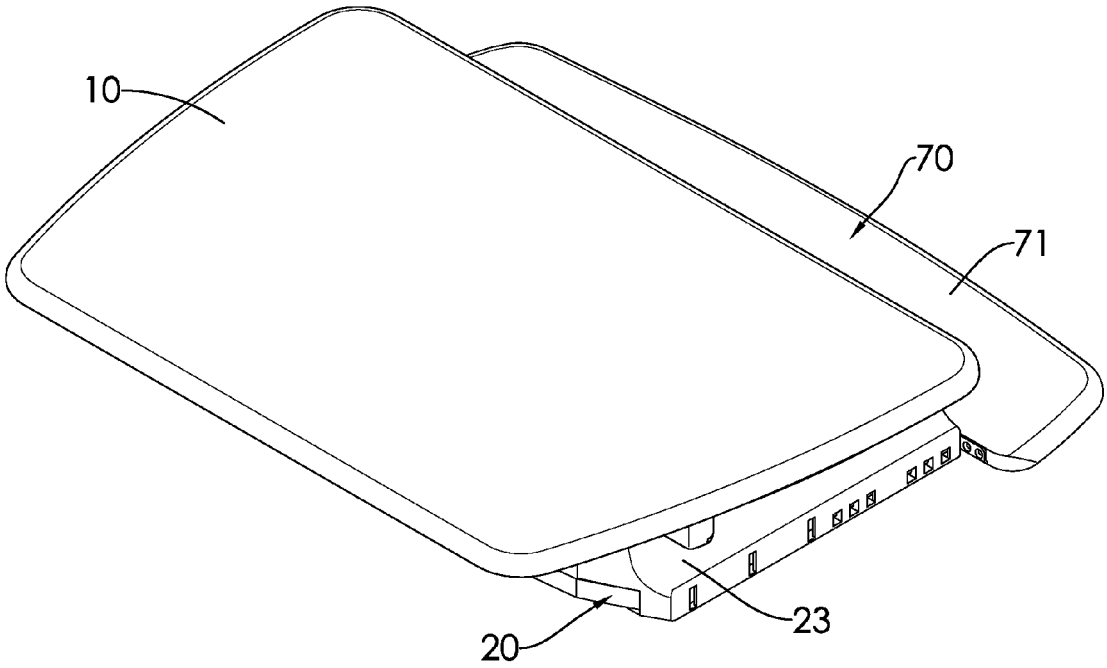
FIG. 12 is a perspective view of an embodiment of the adjustable desk platform, showing the tray.
Figure 13:
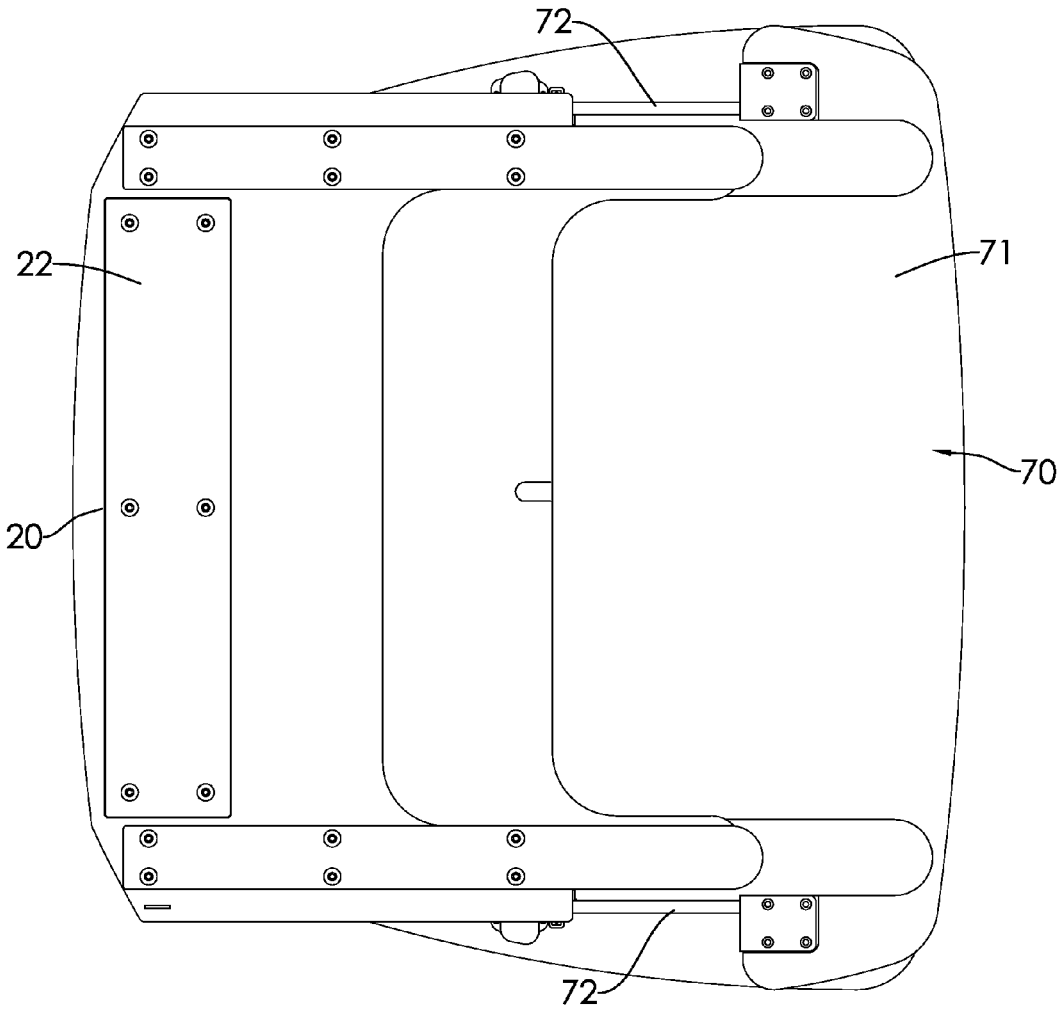
FIG. 13 is a bottom view of an embodiment of the adjustable desk platform showing the tray and counter weights.

As shown in FIGS. 3, 10, and 11, as the primary and secondary pivot arms 31, 32 pivot with respect to the respective upper mounting bracket 21, the boss 321 slides within arc slot 211 of the upper mounting bracket 21, and accordingly, stretches or relaxes the compression spring 51 of the corresponding biasing mechanism 50. Referring to FIG. 11, since pivot point 54 leans against the bottom side of booster spring 53, when upper platform 10 and lower platform 20 are moved toward the fully lowered position, boss 321 can press laterally against the booster springs 53, thereby causing booster spring 53 to bend. Thus, in embodiments, the booster springs 53 can provide additional upward bias when the upper platform 10 is in or near the fully lowered position.

As shown in FIGS. 3, 8, 9, when the user desires to increase the distance between the lower platform 20 and the upper platform 10, the user can pull the handle(s) of the locking set(s) 40 to impact locking set 40, springs 44, and anchors 41, causing anchors 41 to retract from the perforation 3111 and hole 111, releasing the primary and secondary pivot arms 31, 32 so the spacing between the upper platform 10 and the lower platform 20 can be increased.

As shown in FIGS. 3, 10, and 11, lowering the upper platform 10 causes the pivot arm sets 30 to pivot with respect to the upper mounting brackets 21. The resultant rotation of the secondary pivot arms 32 causes the respective bosses 321 to slide within the respective arc slots 211, thereby stretching the respective compression springs 51 of the biasing mechanisms 50, providing a measure of resistance against lowering of the upper platform 10. When the distance between the upper platform 10 and the lower platform 20 is gradually increased from the fully lowered position, bosses 321 slowly pull away from the respective booster springs 53, and allows the booster springs 53 to retract to their natural, unbent state.

Increasing the weight on upper platform 10 (e.g., by placing an item on the upper platform 10) can increase the difficulty of raising the upper platform 10 from the lower platform 20. Due to the configuration of the biasing mechanism 50, booster spring 53, and pivot point 54, when upper platform 10 is raised from the lower platform 20, the elastic force of booster spring 53 and spring 51 can influence the boss 321 of each secondary pivot arm 32, causing secondary pivot arm 32 to generate an upward lifting force, reducing the amount of effort required from the user to raise the upper platform 10.

When lifting upper platform 10, the overall center of gravity of the adjustable desk platform can shift between lower platform 20 and upper platform 10, especially when various items are placed on top of upper platform 10. Because items located on the upper platform create additional weight, the overall center of gravity of the adjustable desk platform will quickly shift to the upper platform 10, and potentially make the adjustable desk platform unstable. Accordingly, the counterweight(s) 22 can increase the weight of lower platform 20, thereby helping to counterbalance the weight of the upper platform 10 when in the raised position and/or when weighted with items.

According to embodiments, the housings 23 of upper platform 10 and the housings 46 of locking set 40 can help protect the user's fingers or other foreign matter from being caught in the locking sets 40, the pivot arm sets 30, and/or inside of the biasing mechanisms 50. Housings 23 and housings 46 can also add to the aesthetic appearance of the adjustable desk platform.

Referring to FIGS. 1 and 2, the adjustable desk platform can include a keyboard tray 70. The keyboard tray 70 can be detachably connected with lower platform 20. Keyboard tray 70 includes a tray portion 71 and one or more releasable joint component(s) 72. According to an embodiment, two joint components 72 can be connected on opposed sides of tray portion 71. The joint components 72 can be slidably mounted on the lower platform 20. Additionally or alternatively, the joint components 72 can be drilled in the housing 23 of lower platform 20. The joint components are not limited to the embodiments shown, and other connectors known in the art can be used as alternatives.

When desired, the keyboard tray 70 can be attached to lower platform 20, and items can be placed on it, such as a keyboard. According to embodiments, tray 70 can be located at an adjustable distance from the lower platform 20.

Figure 14:
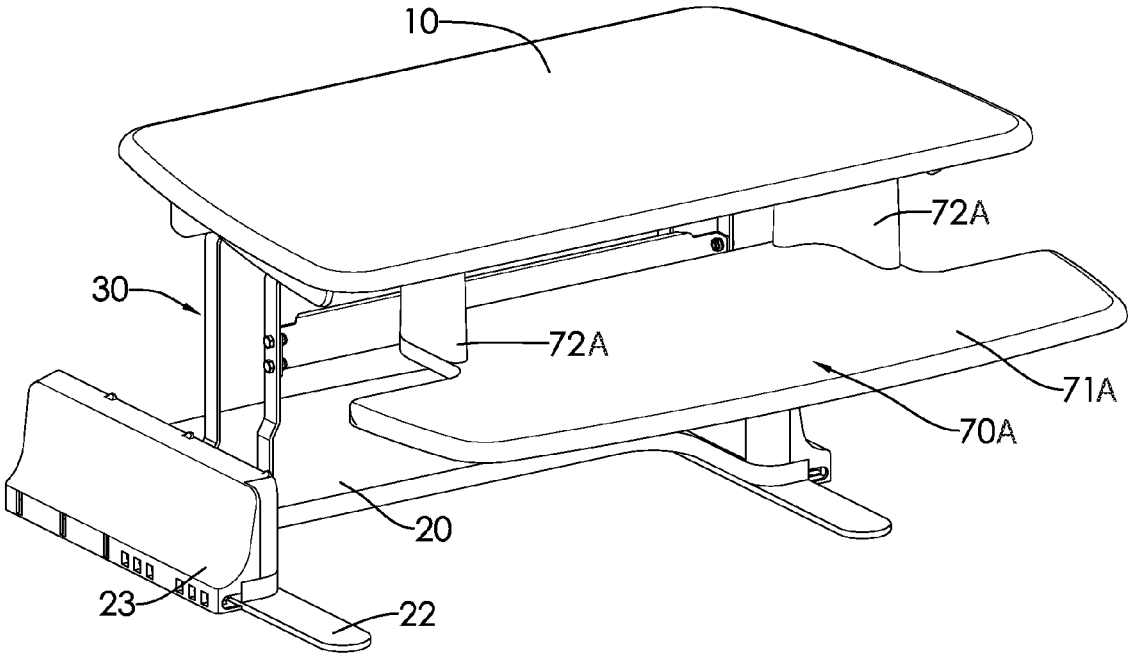
FIG. 14 is a perspective view of an embodiment of the adjustable desk platform including a keyboard tray.

Referring to an alternative embodiment shown in FIG. 14, the keyboard tray 70A can be attached to the bottom side of the upper platform 10. For example, a joint component 72A can connect the tray portion 71A to the underside of the lower platform 10. When in use, keyboard tray 70A may move up and down with upper platform 10, thereby making it more convenient to access items placed on keyboard tray 70, such as a keyboard.

Figure 15:
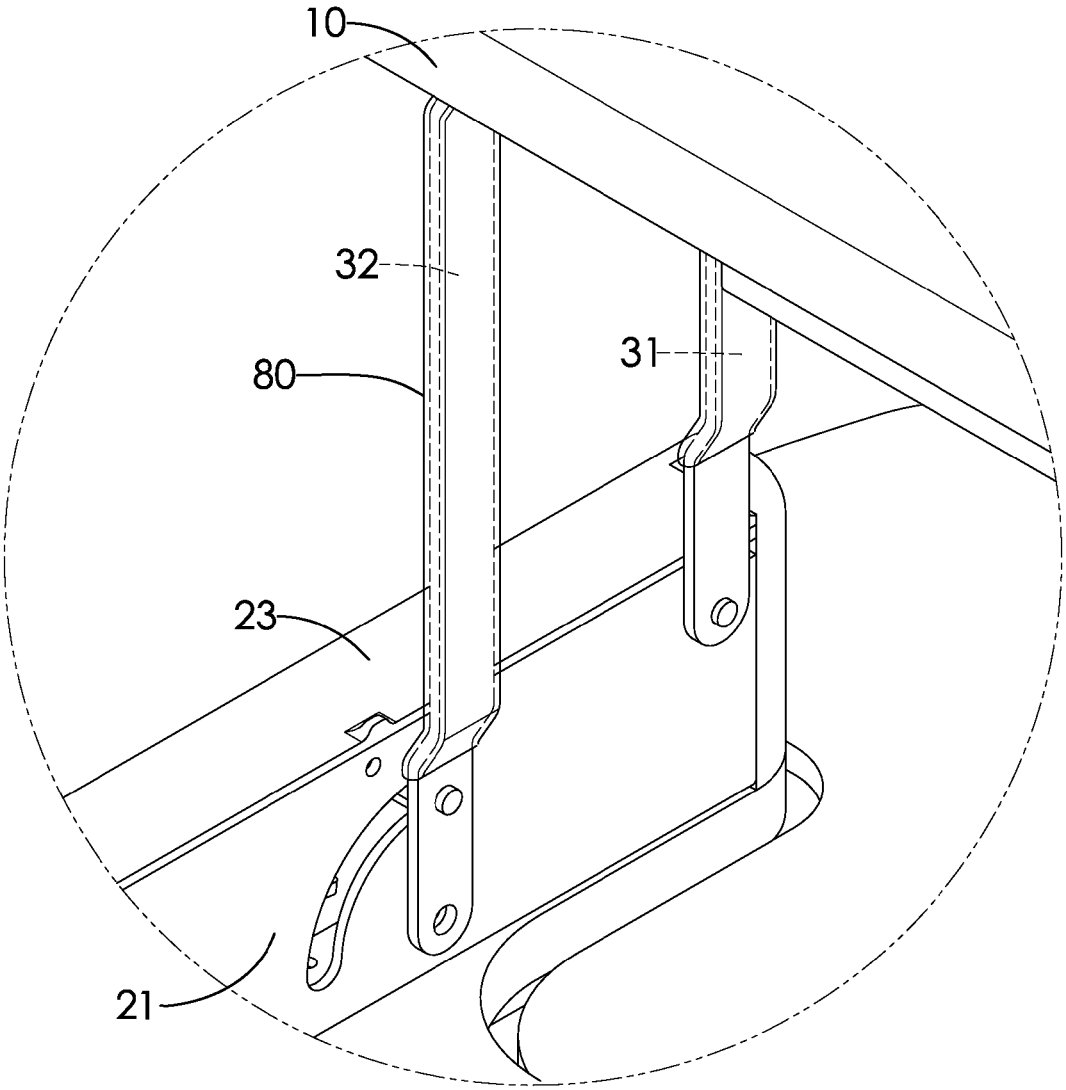
FIG. 15 is an enlarged, perspective view of the pivot arms of an embodiment of the adjustable desk platform.

Referring to FIG. 15, the main pivot arm 31 and/or secondary pivot arm 32 can be cladded with a protector 80. According to an embodiment, the protector 80 is made with EVA foam (ethylene-vinyl acetate copolymer), however other materials are possible. Protector 80 can help prevent jammed fingers due to an operator reaching between pivot arm sets 30 and upper mounting brackets 21.

Figure 16:
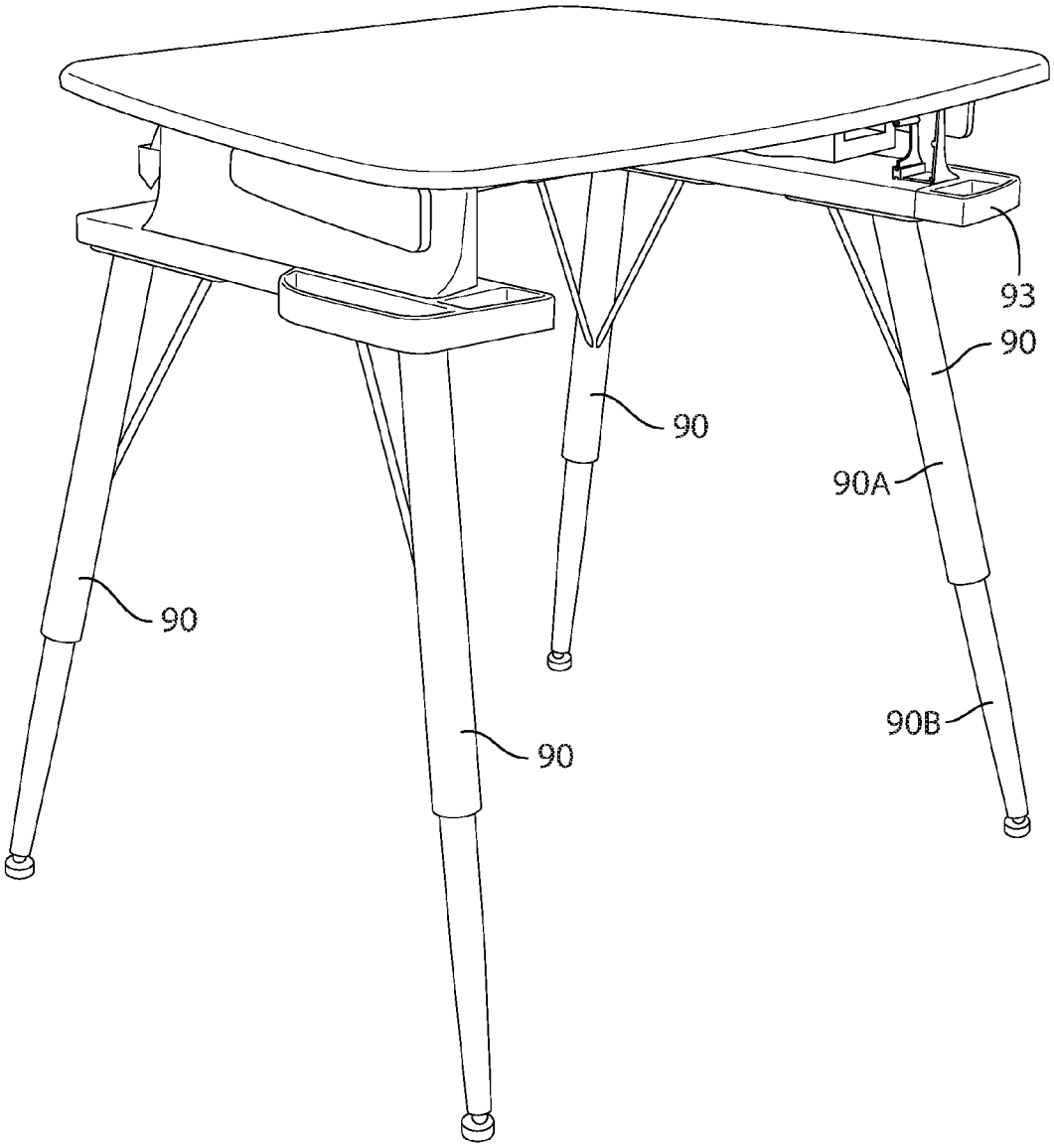
FIG. 16 is a perspective view of an embodiment of the adjustable desk platform including legs.
Figure 17:
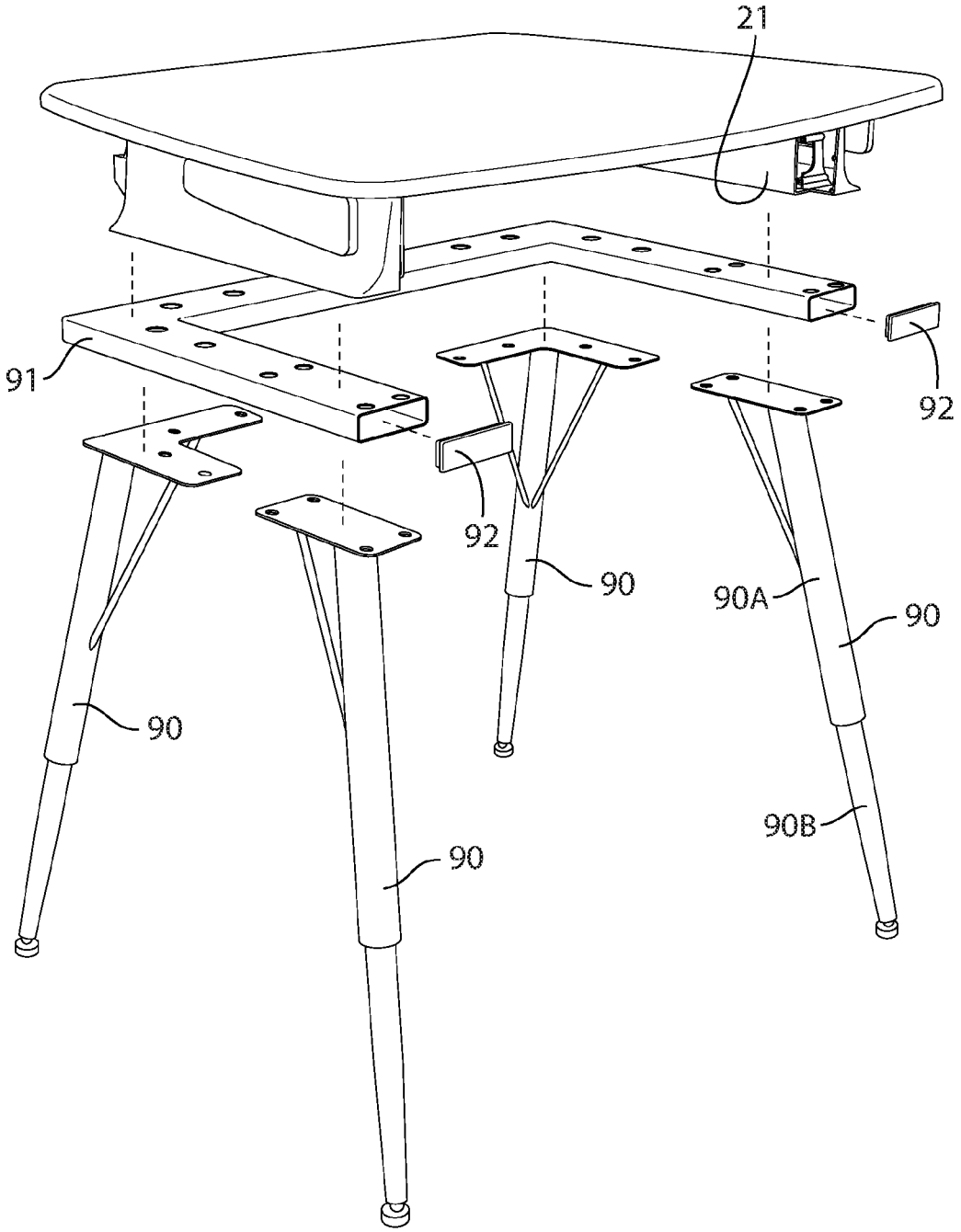
FIG. 17 is a partially exploded, perspective view of the adjustable desk platform with legs of FIG. 16.

Referring to FIGS. 16 and 17, embodiments of the adjustable desk platform can include legs that support the adjustable desk platform above the ground. For example, the adjustable desk platform can include four legs 90 extending from its corners, as shown, however, more or less than four legs are possible. The legs 90 can be fixed in length, or alternatively, can be adjustable in length using structures known in the art. For example, according to embodiments, the legs may telescope to adjust their length. For example, as shown in FIG. 16, each leg 90 can include a first portion 90A and a second portion 90B that telescopes within the first portion 90A to adjust the leg length. Conventional structures can be utilized to lock the position of the second portion 90B with respect to the first portion 90A. One of ordinary skill in the art will understand based on this disclosure that other configurations of telescoping legs 90 can be provided. Moreover, one of ordinary skill in the art will understand based on this disclosure that other configuration of legs besides telescoping legs can be used to provide adjustable leg lengths.

The legs 90, whether fixed or adjustable in length, can allow the adjustable desk platform to be self-supported above the ground. Casters, rollers, wheels, or other structures (not shown) can be provided at the bottom of the legs 90 to facilitate movement of the adjustable desk platform. Except for the provision of legs and the related structures, embodiments of the adjustable desk platform shown in FIGS. 16 and 17 can be substantially the same as described in connection with FIGS. 1-15.

Referring to FIG. 17, the adjustable desk platform can include a frame member 91 that attaches, for example, to the upper mounting brackets 21, lower platform (not shown), or other part of the adjustable desk platform. For example, fasteners such as bolts or rivets, welding, bonding, or other attachment techniques can be used. The legs 90 can in turn be attached to the frame member 91, for example, using fasteners such as bolts or rivets, welding, bonding, or other attachment techniques. As shown in FIG. 17, an embodiment can include end caps 92 that extend into open ends of the frame member 91, however, other configurations are possible. Referring back to FIG. 16, embodiments can include a cover portion 93 that extends over and conceals all or a portion of the frame member 91, thereby improving the safety and/or appearance of the adjustable desk platform.

Although not shown, lateral supports can extend between one more pairs of the legs 90.

Referring to FIGS. 18-21, another embodiment of the adjustable desk platform is shown. The embodiment of FIGS. 18-21 is substantially the same as shown and described in connection with FIGS. 1-15. For example, the adjustable desk platform of FIGS. 18-21 can include the same or similar pivot arm sets 30, locking set(s) 40, biasing mechanism(s) 50, reinforcement member(s) 60, counterweight, legs, and/or other features of previously-described embodiments. Accordingly, only additions or differences from previous embodiments are described below.

Generally similar to the embodiment of FIG. 14, the adjustable desk platform of FIGS. 18-21 can include a keyboard tray 70A suspended below the upper platform 10. The keyboard tray 70A can be adapted to support a computer keyboard, mouse, tablet computer, or other device. For example, the keyboard tray 70A can be substantially planar, and can have a size equal to, or greater than, a conventional computer keyboard. According to an embodiment, the surface area of the keyboard tray 70A is between about one half and about one quarter of the surface area of the upper platform. According to an embodiment, the surface area of the keyboard tray 70A is about one third of the surface area of the upper platform 10. In order to provide sufficient space for the keyboard tray 70A, according to embodiments, the pivot arm sets 30 can be lengthened as compared to embodiments without the keyboard tray, for example, to increase distance between the upper platform 10 and lower platform 20. For example, the pivot arms sets 30 may be increased lengthwise by between about 2" and about 5" as compared to embodiments without the tray, more specifically, by about 3" to about 4".

Figure 18:
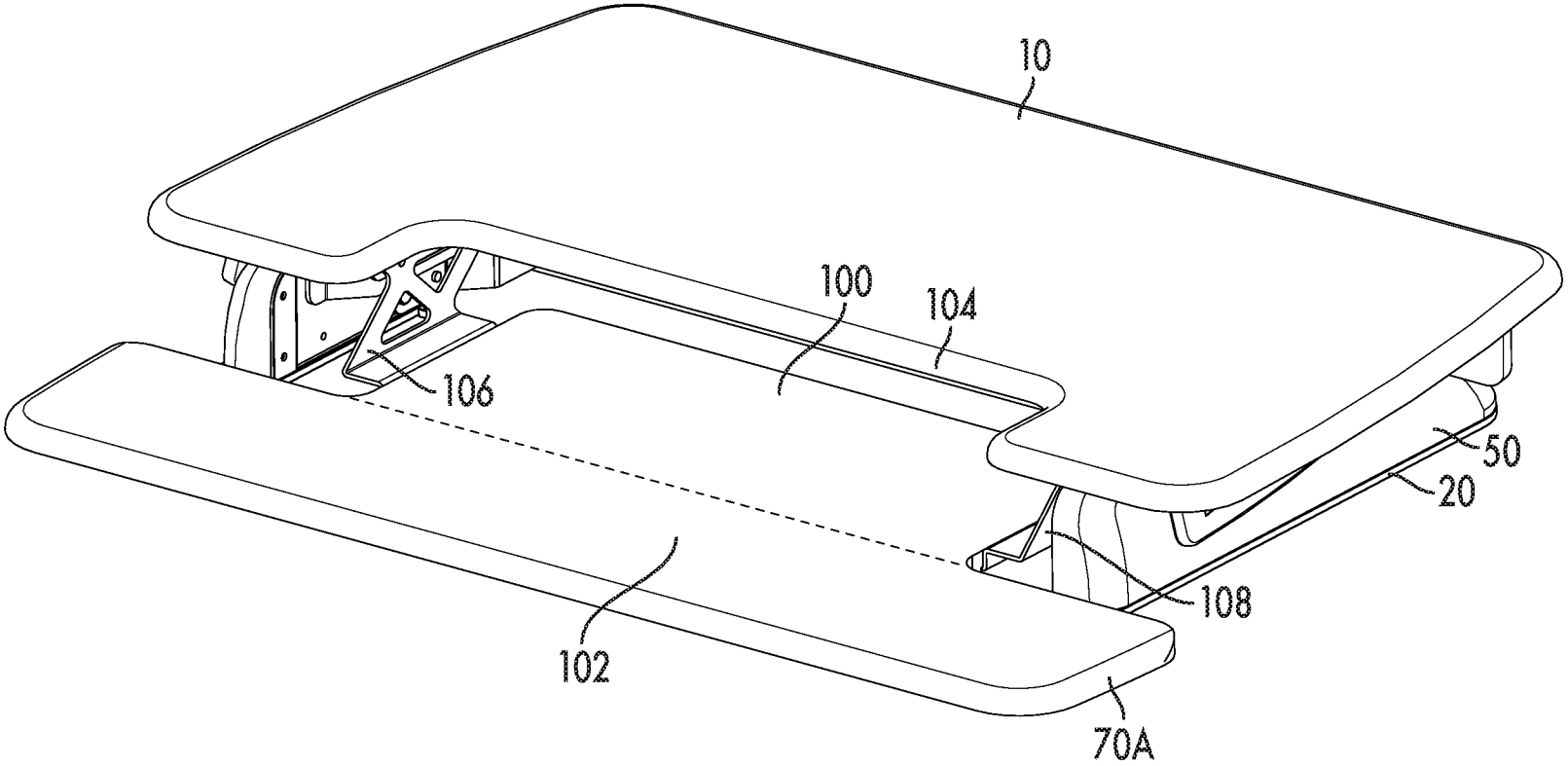
FIG. 18 is a perspective view of another embodiment of the adjustable desk platform, shown in a fully lowered position.
Figure 19:
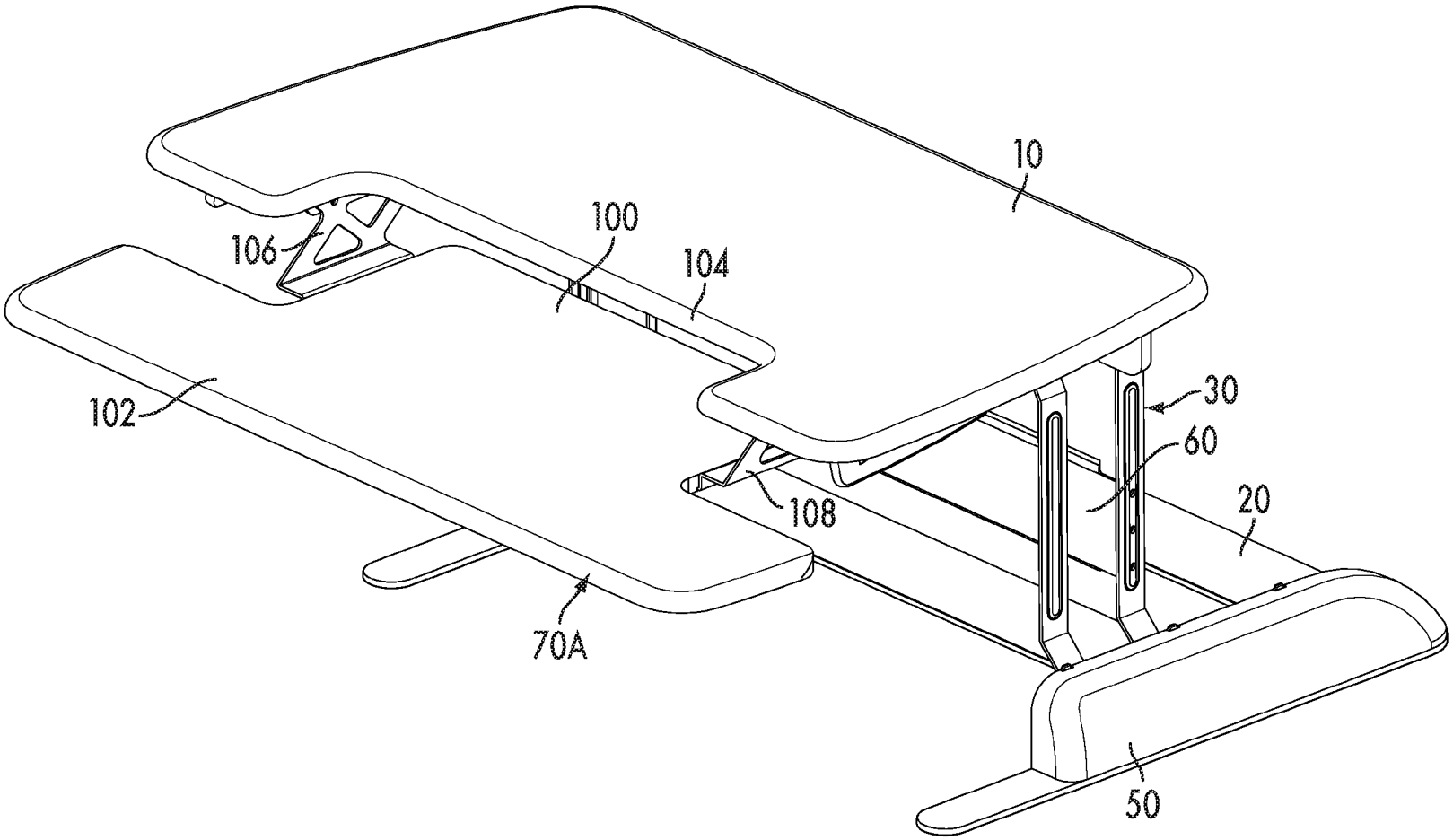
FIG. 19 is a perspective view of the adjustable desk platform of FIG. 18, shown in a fully raised position.
Figure 20:
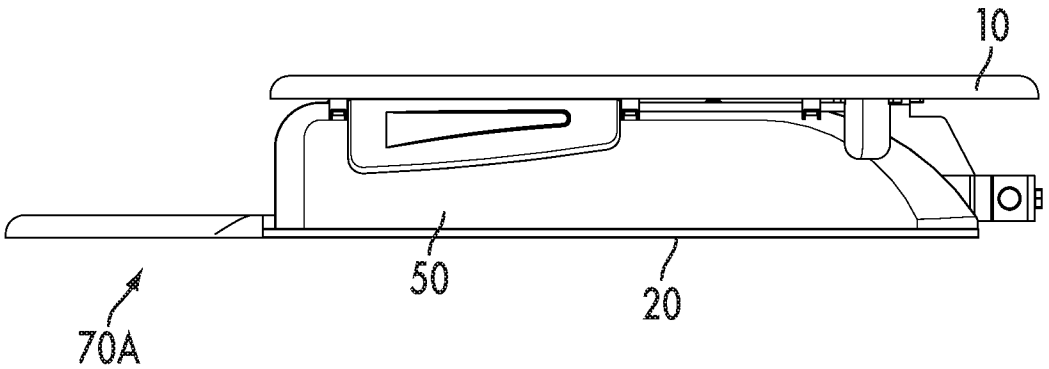
FIG. 20 is a side view of the adjustable desk platform of FIG. 18, shown in the fully lowered position.

As best seen in FIGS. 18 and 19, the keyboard tray 70A can be generally "T"-shaped, in that it can define a relatively narrow portion 100 joined to a relatively wide portion 102 to define a "T" shape. The narrow portion 100 and wide portion 102 are shown separated by an imaginary dashed line in FIG. 18 for illustration purposes only. The edge of the upper platform 10 adjacent the keyboard tray 70A can also define a recess 104, such as a generally "U" shaped recess. The width of the recess 104 can be the same or similar to the width of the narrow portion 100 of the keyboard tray 70A. As a result, the narrow portion 100 of the keyboard tray 70A can be positioned generally in registry with the recess 104, for example, for ergonomic reasons.

Figure 21:
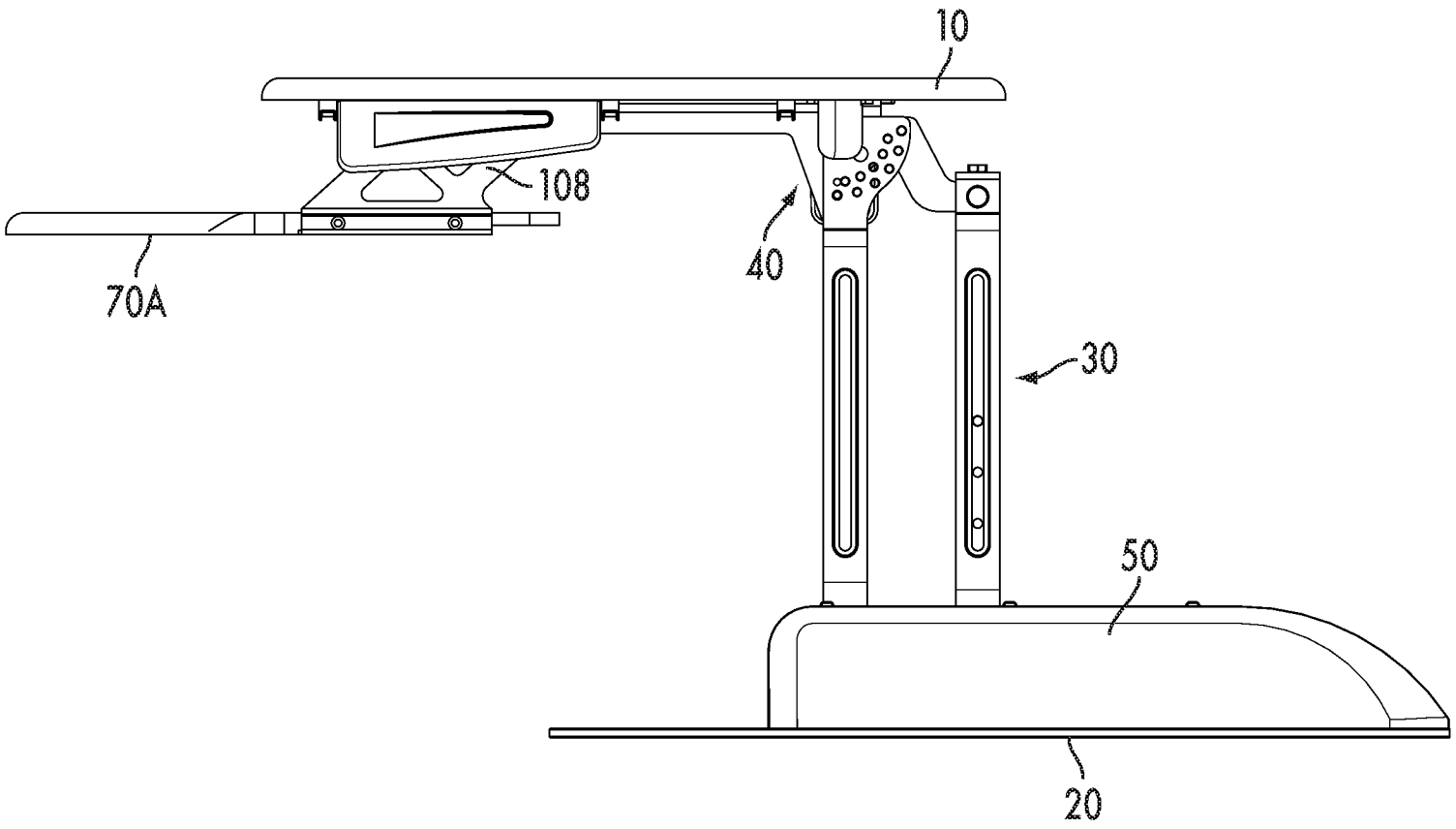
FIG. 21 is a side view of the adjustable desk platform of FIG. 18, shown in the fully raised position.

Referring to FIGS. 18 and 21, first and second support members 106, 108 can connect the keyboard tray 70A to the upper platform 10. According to embodiments, the first and second support members 106, 108 can be located adjacent opposite sides of the generally U-shaped recess 104. Additionally or alternatively, the first and second support members 106, 108 can be located adjacent opposite ends of the narrow portion 100 of the T-shaped keyboard tray 70A. According to this embodiment, the narrow portion 100 of the keyboard tray 70A can fit the keyboard, and the wide portion 102 of the keyboard tray 70A can provide additional support for the user's hands or wrists, however, other uses are possible. One of ordinary skill in the art will understand based on this disclosure that the upper platform 10 and keyboard tray 70A are not limited to the specific shapes and appearances shown in FIGS. 18-21.

Still referring to FIGS. 18 and 21, the support members 106, 108 can comprise metal brackets, such as stamped metal brackets, that are connected to the keyboard tray 70A and to the upper platform 10 on opposite ends, for example, using fasteners such as screws, nails, rivets, or bonding or other techniques known in the art. Alternatively, all or a part of the support members 106, 108 can be integral (e.g., monolithic) with the upper platform 10 and/or keyboard tray 70A. According to the embodiment shown, the support members 106, 108 can have cutouts, e.g., forming an X-shape, in order to decrease weight and material, however, other configurations are possible.

Figure 22:
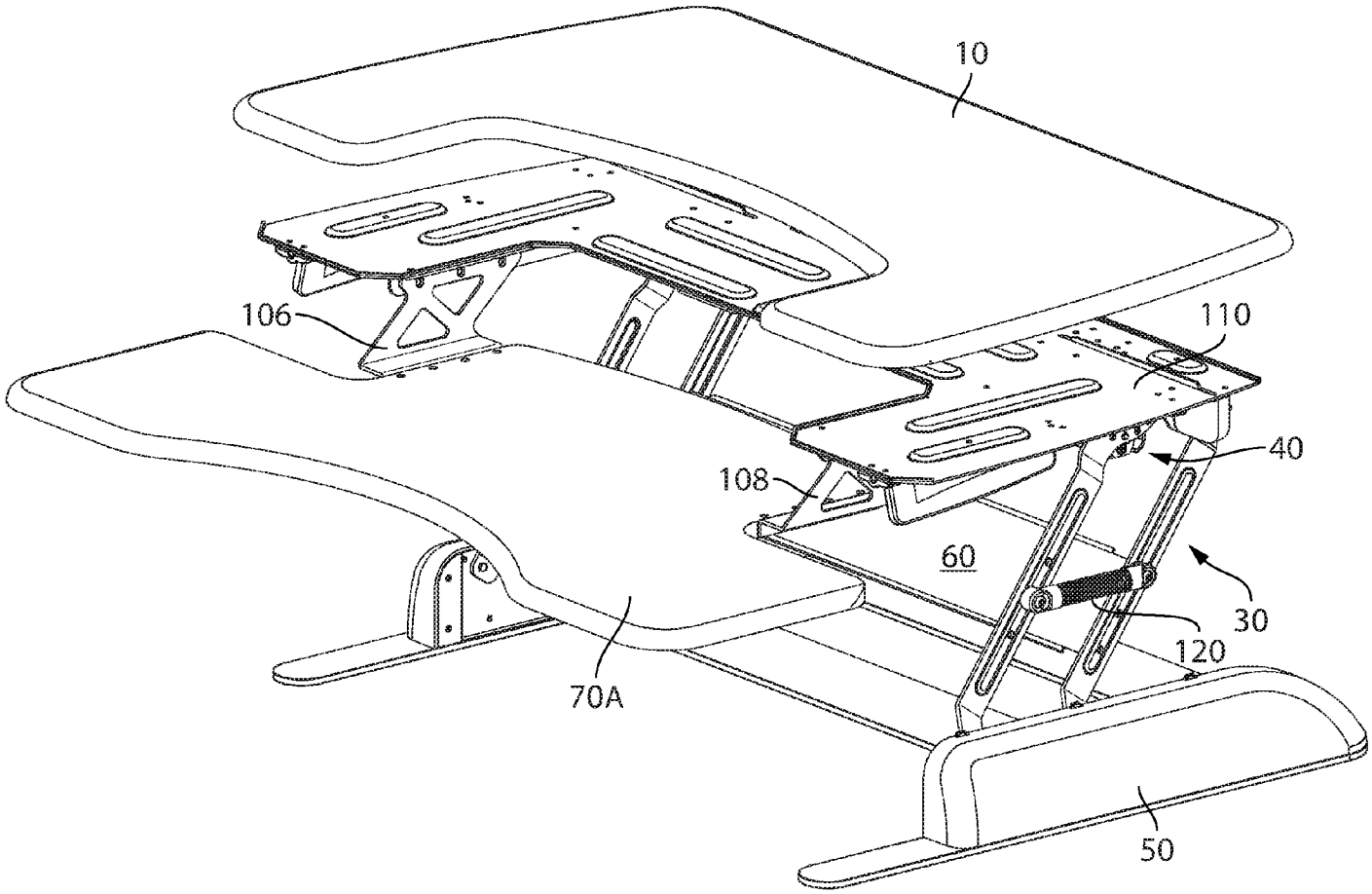
FIG. 22 is a partially-exploded, perspective view of another embodiment of the adjustable desk platform, shown in a partially raised position.
Figure 23:
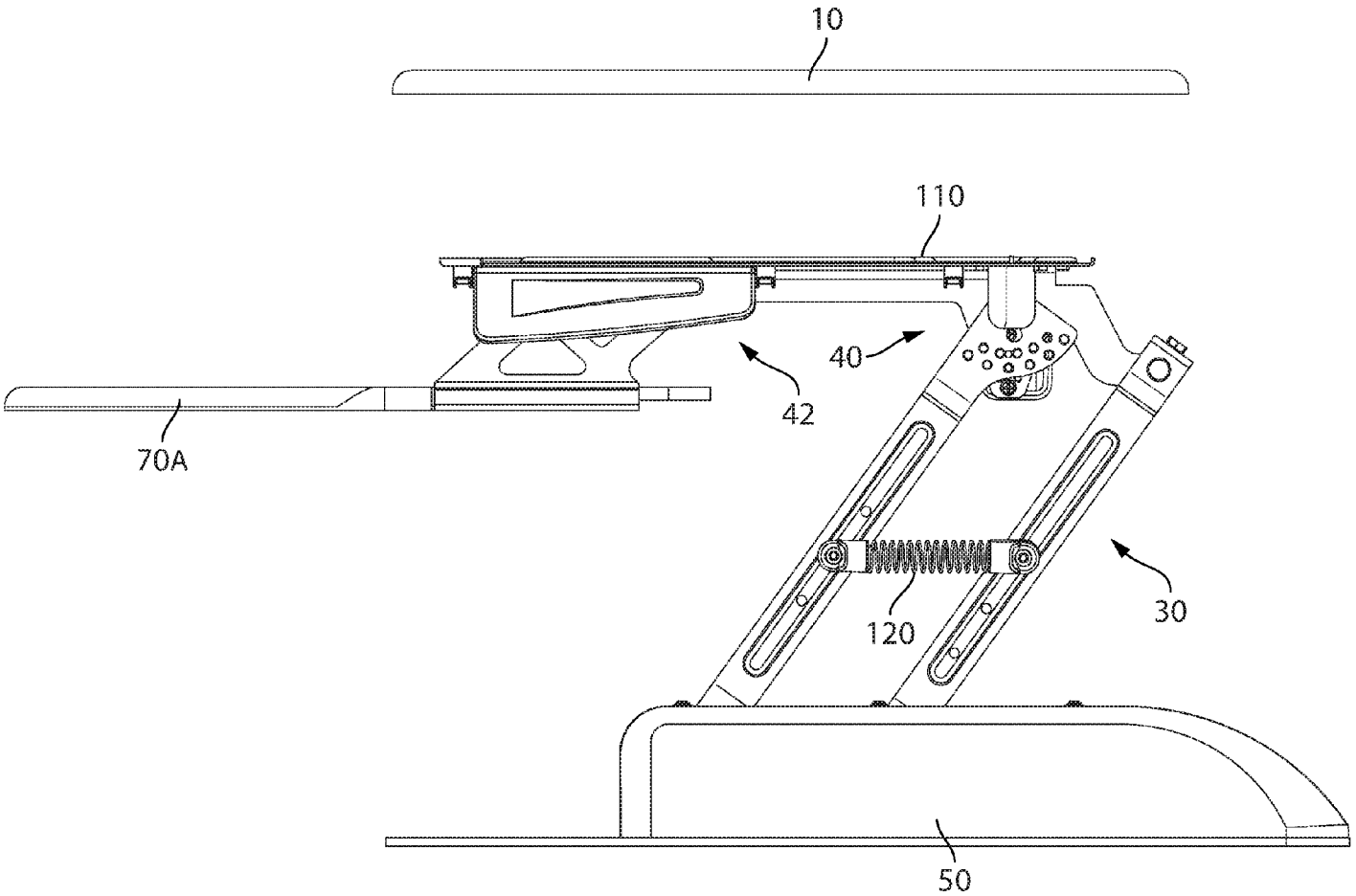
FIG. 23 is a partially-exploded, side view of the adjustable desk platform of FIG. 22, shown in the partially raised position.
Figure 24:
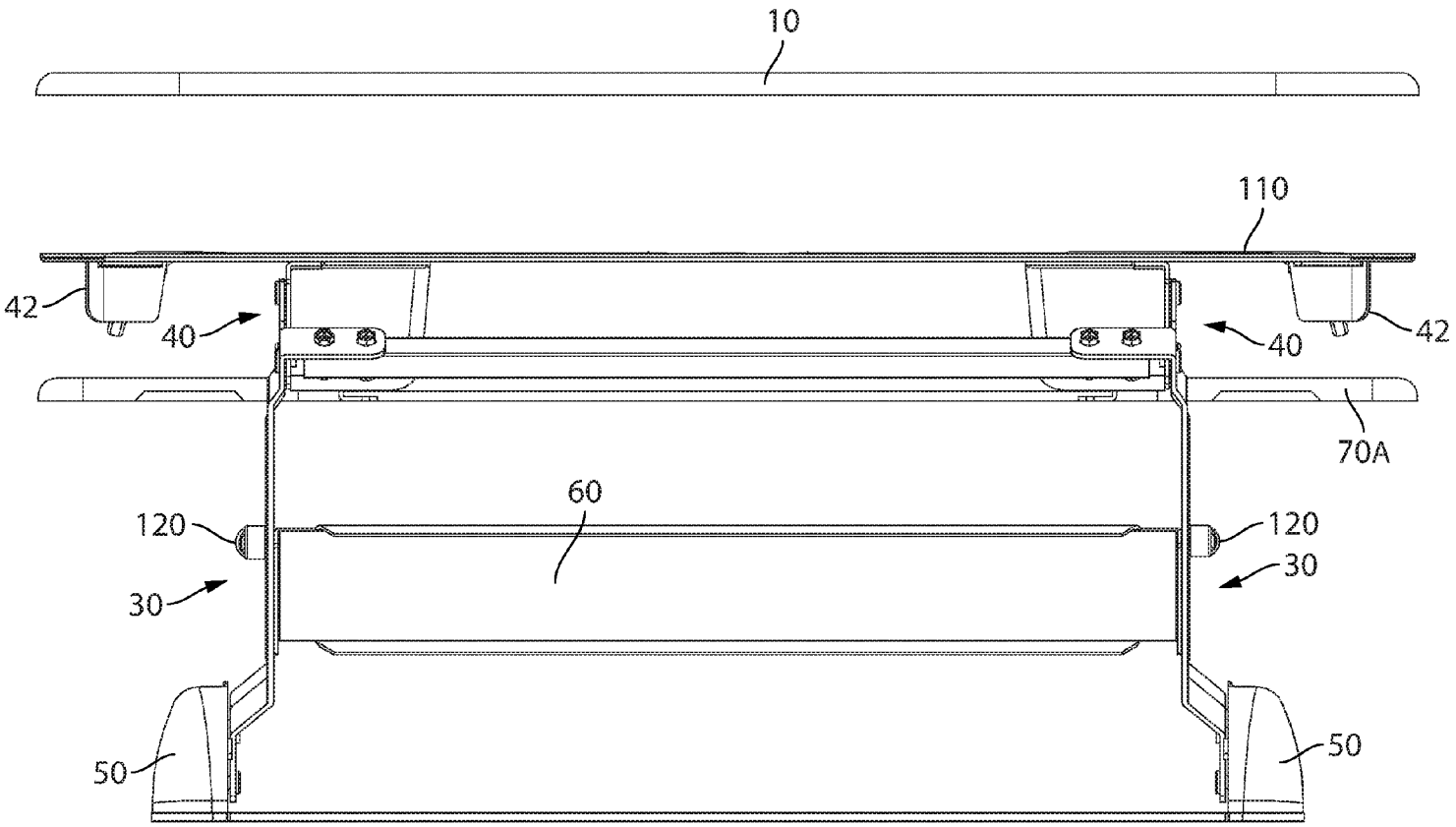
FIG. 24 is a partially-exploded, rear view of the adjustable desk platform of FIG. 22, shown in the partially raised position.

Referring to FIGS. 22-24, another embodiment of the adjustable desk platform is shown. The embodiment of FIGS. 22-24 is substantially the same as shown and described in connection with FIGS. 18-21. For example, the adjustable desk platform of FIGS. 22-24 can include the same or similar pivot arm sets 30, locking set(s) 40, biasing mechanism(s) 50, reinforcement member(s) 60, counterweight, legs, and/or other features of previously-described embodiments. Accordingly, only additions or differences from previous embodiments are described below.

According to an aspect of the embodiment of FIGS. 22-24, the adjustable desk platform can include a plate 110 that serves as a common mounting point for various components, such as the upper platform 10, the pivot arm sets 30, the locking sets 40, the keyboard tray 70A, etc., and related components. Accordingly, instead of mounting these parts to the upper platform 10 itself, they can mount to the plate 110, to which the upper platform 10 can also be mounted. This configuration can facilitate easier assembly and/or transportation of the adjustable desk platform, as the upper platform 10 may no longer need to provide mounting support for the various components. Additionally or alternatively, the plate 110 can facilitate replacement of the upper platform 10 in the event the upper platform 10 becomes damaged. According to embodiments, the plate 110 can be formed from metal, such as steel, however, other materials including wood, plastics, and composites are also possible.

Referring to FIG. 22, according to embodiments, the support members 106, 108 for the keyboard tray 70A can be secured to the plate 110, for example to the underside thereof, by rivets, screws, welding, bonding, or other fastening techniques known in the art. Referring to FIG. 23, the pivot arm sets 30 can additionally or alternatively be secured to the plate 110 (e.g., by the respective mounting brackets located on the underside of the plate 110), for example, by rivets, screws, welding, bonding, or other fastening techniques known in the art. As best shown in FIG. 24, the locking sets 40 and/or related components (e.g., handles 42) can additionally or alternatively be secured to the plate 110 using similar fastening techniques. The upper platform 10 can in turn attach to the plate 110, for example, using screws extending through the plate and into the upper platform 10 from below. Alternatively, bonding, staples, or other fastening techniques known in the art can be used to attach the upper platform 10 to the plate 110.

In the embodiment of FIGS. 22-24, as well as prior embodiments, the upper platform 10 and/or keyboard tray 70A can be formed of a substrate such as wood (e.g., particle board), plastic, composite, or other material. A decorative layer can be applied over the substrate, for example, such as by painting, powder coating, or wrapping in a film such as a nylon film. One of ordinary skill in the art will appreciate based on this disclosure, however, that other techniques can be employed to provide a decorative and/or protective finish to the upper platform 10 and/or keyboard tray 70A.

Although the keyboard tray 70A is shown substantially fixed in position in FIGS. 22-24 (and proceeding embodiments), alternative embodiments can include a keyboard tray 70A that is adjustable in position. For example, according to embodiments, the keyboard tray 70A can adjust up/down, left/right, forward/rearward, and/or can pivot about various axes with respect to the upper platform 10. One of ordinary skill in the art will appreciate based on this disclosure that various adjustment and/or pivoting structures can be utilized to provide the aforementioned movements to the keyboard tray 70A.

Referring to FIGS. 22 and 23, an elastic member 120 such as a spring, can be secured between the arms of each pivot arm set 30. For example, the elastic member 120 can be secured at each end to one of the arms using known fastening techniques, such as screws, bolts, rivets, bonding, welding, etc. The elastic members 120 and/or pivot arm sets 30 can be configured for the elastic members 120 to relax as the upper platform 10 is moved upward toward the fully raised position, thus offsetting some of the force required for a user to raise the upper platform 10. According to other embodiments, the elastic member 120 can comprise multiple springs or other elastic devices.

Figure 25:
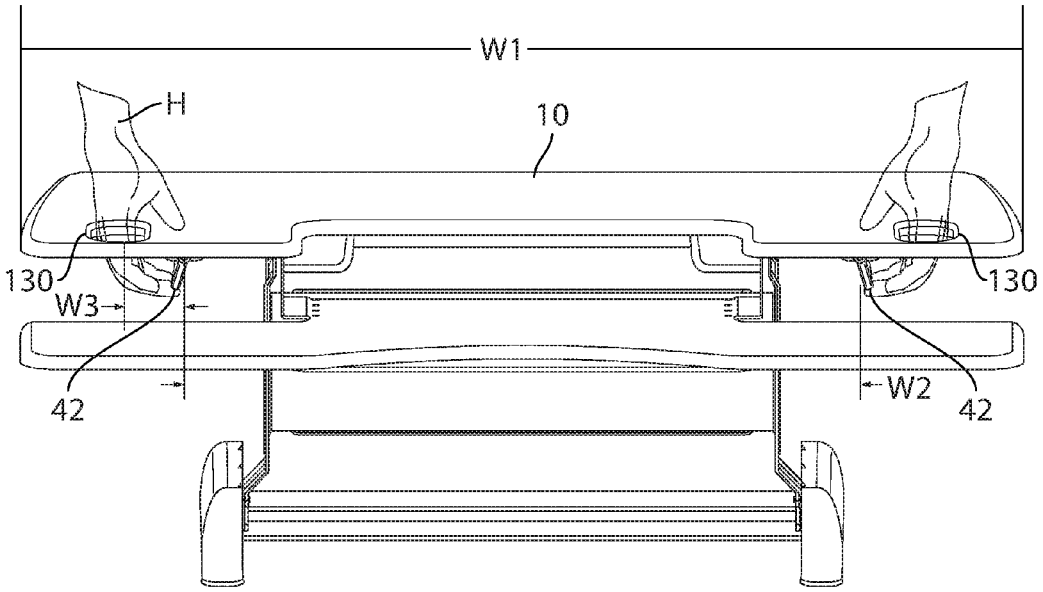
FIG. 25 is a side view of another embodiment of the adjustable desk platform as seen from a user standing behind the desk platform, with the desk in a partially raised position. The user's hands are shown resting on the locking mechanism.
Figure 26:
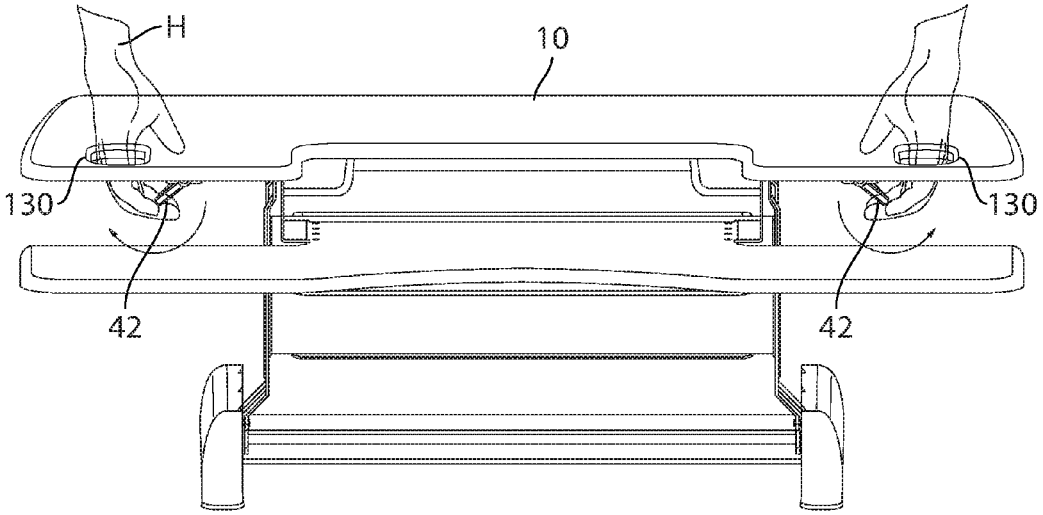
FIG. 26 is similar to FIG. 25, but shows the user's hands moving the locking mechanism.

FIGS. 24 and 25 depict another embodiment of the adjustable desk platform that includes hand apertures 130 extending through the upper platform 10 in the vicinity of the handles 42 of the locking mechanisms 40. Each of the apertures 130 can be shaped and configured to permit passage of all or a portion of the user's hand H therethrough. For example, each aperture 130 can be shaped and configured for passage of at least the four fingers of the user's hand H, as shown. According to embodiments, the apertures 130 can be substantially oval-shaped or can have the shape of an elongated slot, however, other embodiments are possible. Each aperture 130 can be located next to, or substantially next to, the respective handle 42, such that when a user extends his fingers into the aperture 130 from above, his or her fingertips can touch and manipulate the handle 42. According to embodiments, the lateral centerpoint of each aperture 130 can be offset from the lateral center of the respective handle 42 (e.g., the central pivot point in the embodiment shown) by a lateral distance W3 of between about 2 and about 4 inches, however, other embodiments are possible. FIG. 25 depicts the handles 42 after the user as moved them from the locked position toward the unlocked position.

The arrangement of the apertures and handle 42 can be used on any of the embodiments of adjustable desk platforms described herein. The arrangement of apertures 130 and handles 42 can be useful in embodiments having a wide upper platform 10, for example and without limitation, those with a width W1 of about 48 inches or greater. For example, with embodiments having an upper platform 10 of this size, it may be difficult or uncomfortable for the user to reach around the lateral ends of the platform to reach the handles 42 (e.g., due to limited wingspan). Accordingly, the apertures 130 can allow the handles 42 to be separated by a comfortable width W2 of between about 18 and about 36 inches, for example, between about 28 and 32 inches, while the upper platform 10 has a larger overall width W1.

The embodiments illustrated and discussed in this specification are intended only to teach those skilled in the art the best way known to the inventors to make and use the invention. Nothing in this specification should be considered as limiting the scope of the present invention. For example, the arrangement of features with respect to the upper platform and the lower platform, such as, e.g., the locking mechanism, can be reversed. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. An adjustable desk platform comprising:

an upper platform defining a substantially planar work surface, the upper platform defining a recess;

a base located beneath the upper platform, the base defining a bottom that is adapted to sit on an existing desk;

first and second sets of arms coupling the upper platform to the base, wherein the first and second sets of arms are adapted for movement of the upper platform substantially in parallel with the base between a raised position and a lowered position;

a keyboard tray suspended below the recess in the upper platform, wherein the keyboard tray defines first and second lateral edges;

a first support bracket extending between the upper platform and the first lateral edge of the keyboard tray; and a second support bracket extending between the upper platform and the second lateral edge of the keyboard tray;

wherein the first support bracket and the second support bracket are located on opposite sides of the recess, and the surface area of the keyboard tray is less than the surface area of the upper platform.

2. The adjustable desk platform of claim 1, wherein the recess defines first and second lateral sides, and the first support bracket extends between the first lateral side of the recess and the first lateral edge of the keyboard tray, and the second support bracket extends between the second lateral side of the recess and the second lateral edge of the keyboard tray.

3. The adjustable desk platform of claim 2, wherein the recess is substantially U-shaped.

4. The adjustable desk platform of claim 1, further comprising:

a locking mechanism associated with the upper platform, the locking mechanism adapted to releasably lock the upper platform in the raised position and in at least one intermediate position between the raised position and the lowered position.

5. The adjustable desk platform of claim 4, wherein the locking mechanism comprises:

a first anchor biased into a locked position to immobilize the first set of arms;

a second anchor biased into a locked position to immobilize the second set of arms;

a first handle user-operable to move the first anchor into an unlocked position to permit movement of the first set of arms; and a second handle user-operable to move the second anchor into an unlocked position to permit movement of the second set of arms.

6. The adjustable desk platform of claim 5, further comprising:

a first linkage extending between the first handle and the first anchor; and a second linkage extending between the second handle and the second anchor.

7. The adjustable desk platform of claim 1, wherein the first set of arms comprises a first arm and a second arm and the second set of arms comprises a third arm and a fourth arm, the adjustable desk platform further comprising:

a first elastic member extending between the first arm and the second arm; and a second elastic member extending between the third arm and the fourth arm.

8. The adjustable desk platform of claim 7, wherein the first and second elastic members comprise coil springs.

9. The adjustable desk platform of claim 1, further comprising:

a first boss located on the first set of arms;

a first spring extending between the base and the first boss;

a second boss located on the second set of arms; and a second spring extending between the base and the second boss;

wherein the first and second springs bias the upper platform toward the raised position.

10. The adjustable desk platform of claim 9, further comprising:

a third spring located on the base; and a fourth spring located on the base;

wherein movement of the upper platform toward the lowered position causes the first and second bosses to deflect the third and fourth springs, respectively.

11. The adjustable desk platform of claim 1, wherein the upper platform moves laterally with respect to the base when moved from the lowered position to the raised position.

12. The adjustable desk platform of claim 1, wherein the bottom of the base is without legs.

13. An adjustable desk platform comprising:

an upper platform defining a substantially planar work surface, the upper platform defining a recess having first and second lateral sides, and a third side substantially transverse to the first and second lateral sides;

a base located beneath the upper platform, the base defining a bottom that is adapted to sit on an existing desk;

first and second sets of arms coupling the upper platform to the base, wherein the first and second sets of arms are adapted for movement of the upper platform substantially in parallel with the base between a raised position and a lowered position, wherein the upper platform moves laterally with respect to the base when moved from the lowered position to the raised position;

a reinforcement member extending between the first set of arms and the second set of arms;

a keyboard tray suspended below the recess in the upper platform, wherein the keyboard tray defines first and second lateral edges;

a first support bracket extending between the upper platform and the first lateral edge of the keyboard tray;

a second support bracket extending between the upper platform and the second lateral edge of the keyboard tray, wherein the first support bracket and the second support bracket are located on opposite sides of the recess, and the surface area of the keyboard tray is less than the surface area of the upper platform.

14. The adjustable desk platform of claim 13, further comprising:

a first mounting bracket extending below the upper platform, wherein the first set of arms is connected to the first mounting bracket; and a second mounting bracket extending below the upper platform, wherein the second set of arms is connected to the second mounting bracket.

15. The adjustable desk platform of claim 13, further comprising:

a locking mechanism associated with the upper platform, the locking mechanism adapted to retain the upper platform in the raised position and in at least one intermediate position between the raised position and the lowered position.

16. The adjustable desk platform of claim 15, wherein the locking mechanism comprises:

a first handle connected to the upper platform, the first handle upper-operable to release the first locking mechanism to permit movement of the upper platform with respect to the base; and a second handle connected to the upper platform, the first handle user-operable to release the second locking mechanism to permit movement of the upper platform with respect to the base.

17. The adjustable desk platform of claim 13, wherein the first set of arms comprises a first arm and a second arm and the second set of arms comprises a third arm and a fourth arm, the adjustable desk platform further comprising:

a first elastic member extending between the first arm and the second arm; and a second elastic member extending between the third arm and the fourth arm.

18. The adjustable desk platform of claim 17, wherein the first and second elastic members comprise coil springs.

19. The adjustable desk platform of claim 13, further comprising:

a first boss located on the first set of arms;

a first spring extending between the base and the first boss;

a second boss located on the second set of arms; and a second spring extending between the base and the second boss;

wherein the first and second springs bias the upper platform toward the raised position.

20. The adjustable desk platform of claim 19, further comprising:

a third spring located on the base; and a fourth spring located on the base;

wherein movement of the upper platform toward the lowered position causes the first and second bosses to deflect the third and fourth springs, respectively.

21. An adjustable desk platform comprising:

an upper platform defining a substantially planar work surface;

a base located beneath the upper platform, the base defining a bottom that is adapted to sit on an existing desk;

first and second sets of arms coupling the upper platform to the base, wherein the first and second sets of arms are adapted for movement of the upper platform substantially in parallel with the base between a raised position and a lowered position;

a reinforcement member extending between the first set of arms and the second set of arms;

a keyboard tray suspended below the upper platform, wherein the keyboard tray defines first and second lateral edges;

a first support bracket extending between the upper platform and the first lateral edge of the keyboard tray;

a second support bracket extending between the upper platform and the second lateral edge of the keyboard tray, wherein the surface area of the keyboard tray is less than the surface area of the upper platform; and a locking mechanism adapted to releasably lock the upper platform in the raised position and in at least one intermediate position between the raised position and the lowered position, the locking mechanism comprising:

a first anchor biased into a locked position to immobilize the first set of arms;

a second anchor biased into a locked position to immobilize the second set of arms;

a first handle extending below the upper platform, the first handle user-operable to move the first anchor into an unlocked position to permit movement of the first set of arms; and a second handle extending below the upper platform, the second handle user-operable to move the second anchor into an unlocked position to permit movement of the second set of arms;

a first linkage extending between the first handle and the first anchor; and a second linkage extending between the second handle and the second anchor.

22. The adjustable desk platform of claim 21, wherein the locking mechanism further comprises:

a first set of perforations, wherein the first anchor is biased into engagement with the first set of perforations; and a second set of perforations, wherein the second anchor is biased into engagement with the second set of perforations.

23. The adjustable desk platform of claim 21, further comprising:

a first mounting bracket extending below the upper platform, wherein the first set of arms is connected to the first mounting bracket; and a second mounting bracket extending below the upper platform, wherein the second set of arms is connected to the second mounting bracket.

24. The adjustable desk platform of claim 21, further comprising:

a first elastic member connected to the first set of arms, the first elastic member adapted to bias the upper platform toward the raised position; and a second elastic member connected to the second set of arms, the second elastic member adapted to bias the upper platform toward the raised position.

25. The adjustable desk platform of claim 21, wherein the keyboard tray is generally T-shaped.

26. An adjustable desk platform comprising:

an upper platform defining a substantially planar work surface;

a base located beneath the upper platform, the base defining a bottom that is adapted to sit on an existing desk;

first and second sets of arms coupling the upper platform to the base, wherein the first and second sets of arms are adapted for movement of the upper platform substantially in parallel with the base between a raised position and a lowered position;

a first mounting bracket extending below the upper platform, wherein the first set of arms is connected to the first mounting bracket;

a second mounting bracket extending below the upper platform, wherein the second set of arms is connected to the second mounting bracket;

a reinforcement member extending between the first set of arms and the second set of arms;

a keyboard tray suspended below the upper platform, wherein the keyboard tray defines first and second lateral edges;

a first support bracket extending between the upper platform and the first lateral edge of the keyboard tray;

a second support bracket extending between the upper platform and the second lateral edge of the keyboard tray, wherein the surface area of the keyboard tray is less than the surface area of the upper platform;

a locking mechanism adapted to retain the upper platform in the raised position and in at least one intermediate position between the raised position and the lowered position, the locking mechanism comprising:

a first handle extending below the upper platform, the first handle user-operable to permit movement of the upper platform with respect to the base; and a second handle extending below the upper platform, the second handle user-operable to permit movement of the upper platform with respect to the base;

wherein the upper platform moves laterally with respect to the base when moved from the lowered position to the raised position.

27. The adjustable desk platform of claim 26, further comprising:

a first elastic member connected to the first set of arms, the first elastic member adapted to bias the upper platform toward the raised position; and a second elastic member connected to the second set of arms, the second elastic member adapted to bias the upper platform toward the raised position.

28. The adjustable desk platform of claim 26, wherein the keyboard tray is adapted to pivot with respect to the upper platform.

29. An adjustable desk platform comprising:

an upper platform defining a substantially planar work surface, the upper platform defining a recess;

a base located beneath the upper platform, the base defining a bottom that is adapted to sit on an existing desk;

first and second sets of arms coupling the upper platform to the base, wherein the first and second sets of arms are adapted for movement of the upper platform substantially in parallel with the base between a raised position and a lowered position, wherein the upper platform moves laterally with respect to the base when moved from the lowered position to the raised position;

a first mounting bracket extending below the upper platform, wherein the first set of arms is connected to the first mounting bracket;

a second mounting bracket extending below the upper platform, wherein the second set of arms is connected to the second mounting bracket;

a reinforcement member extending between the first set of arms and the second set of arms;

a keyboard tray suspended below the recess in the upper platform, wherein the keyboard tray defines first and second lateral edges;

a first support bracket extending between the upper platform and the first lateral edge of the keyboard tray;

a second support bracket extending between the upper platform and the second lateral edge of the keyboard tray, wherein the first support bracket and the second support bracket are located on opposite sides of the recess, and the surface area of the keyboard tray is less than the surface area of the upper platform; and a locking mechanism adapted to releasably lock the upper platform in the raised position and in at least one intermediate position between the raised position and the lowered position.

30. The adjustable desk platform of claim 29, further comprising:

a first elastic member connected to the first set of arms, the first elastic member adapted to bias the upper platform toward the raised position; and a second elastic member connected to the second set of arms, the second elastic member adapted to bias the upper platform toward the raised position.

31. The adjustable desk platform of claim 29, wherein the keyboard tray is adjustable forward and rearward with respect to the upper platform.

32. The adjustable desk platform of claim 29, wherein the locking mechanism comprises:

a first anchor and a first set of perforations, wherein the first anchor is movable into engagement with the first set of perforations; and a second anchor and a second set of perforations, wherein the second anchor is movable into engagement with the second set of perforations.

33. An adjustable desk platform comprising:

an upper platform defining a work surface;

a base located beneath the upper platform, the base defining a bottom that is adapted to sit on an existing desk;

first and second sets of arms coupling the upper platform to the base, wherein the first and second sets of arms are adapted for movement of the upper platform substantially in parallel with the base between a raised position and a lowered position;

a locking mechanism adapted to retain the upper platform in the raised position and in at least one intermediate position between the raised position and the lowered position, the locking mechanism including first and second handles extending below the upper platform, the first and second handles user-operable to permit movement of the upper platform with respect to the base.

34. The adjustable desk platform of claim 33, further comprising:

a first mounting bracket extending below the upper platform, wherein the first set of arms is connected to the first mounting bracket; and a second mounting bracket extending below the upper platform, wherein the second set of arms is connected to the second mounting bracket.

35. The adjustable desk platform of claim 33, further comprising a reinforcement member extending between the first set of arms and the second set of arms.

36. The adjustable desk platform of claim 33, further comprising a keyboard tray suspended below the upper platform.

* * * * *